US011926965B2

(12) United States Patent
Zhu

(10) Patent No.: US 11,926,965 B2
(45) Date of Patent: Mar. 12, 2024

(54) NATURAL FIBER COMPOSITES AS A LOW-COST PLASTIC ALTERNATIVE

(71) Applicant: Northeastern University, Boston, MA (US)

(72) Inventor: Hongli Zhu, Arlington, MA (US)

(73) Assignee: NORTHEASTERN UNIVERSITY, Boston, MA (US)

( * ) Notice: Subject to any disclaimer, the term of this patent is extended or adjusted under 35 U.S.C. 154(b) by 64 days.

(21) Appl. No.: 17/531,094

(22) Filed: Nov. 19, 2021

(65) Prior Publication Data

US 2022/0162801 A1 May 26, 2022

Related U.S. Application Data

(60) Provisional application No. 63/117,455, filed on Nov. 23, 2020.

(51) Int. Cl.

| | |
|---|---|
| ***D21H 11/12*** | (2006.01) |
| ***D21F 13/00*** | (2006.01) |
| ***D21H 15/10*** | (2006.01) |
| ***D21H 17/17*** | (2006.01) |
| ***D21H 21/16*** | (2006.01) |

(52) U.S. Cl.

CPC ..... *D21H 11/12* (2013.01); *D21F 13/00* (2013.01); *D21H 15/10* (2013.01); *D21H 17/17* (2013.01); *D21H 21/16* (2013.01)

(58) Field of Classification Search

CPC ..... D21H 11/12; D21H 15/10; D21H 21/16; D21H 17/17; D21F 13/00

USPC ..... 162/148

See application file for complete search history.

(56) References Cited

U.S. PATENT DOCUMENTS

2009/0012210 A1* 1/2009 Speer ..... A23L 29/212 523/124

2009/0104314 A1* 4/2009 Dellinger ..... A21B 3/13 426/138

FOREIGN PATENT DOCUMENTS

CA 2 867 056 * 9/2013

WO WO 2013/135632 * 9/2013 ..... D21H 11/14

OTHER PUBLICATIONS

Barnes, D.K.A. et al., "Accumulation and fragmentation of plastic debris in global environments," Philos. Trans. R. Soc. B., vol. 364; 1985-1998 (2009).

Chandra, M. et al., "Real cost of styrofoam," In Experiential Learning Project, Saint Louis University. https://greendiningalliance.org/wp-content/uploads/2016/12/real-cost-of- styrofoam written-report.pdf; 46 pages (2016).

Chen, Y. et al., "Effect of beating on recycled properties of unbleached eucalyptus cellulose fiber," Carbohyd. Polym., vol. 87; No. 1; 730-736 (2012).

Chidambarampadmavathy, K. et al., "Sustainable bio-plastic production through landfill methane recycling," Renew. And Sustain. Energ. Rev., vol. 71; 555-562 (2017).

Degnan, T., Waste-plastic processing provides global challenges and opportunities, MRS Bull., vol. 44; 436-437 (2019).

De Sá, D.S. et al., Fabrication of Lignocellulose-Based Microreactors: Copper-Functionalized Bamboo for Continuous-Flow CuAAC Click Reactions, ACS Sustain. Chem. Eng., vol. 7; No. 3; 3267-3273 (2019).

Didone, M. et al., "Molded Pulp Manufacturing: Overview and Prospects for the Process Technology," Packag. Technol. Sci., vol. 30; 231-249 (2017).

Eriksson, E. et al., "Carbon footprint of cartons in Europe-Carbon footprint methodology and biogenic carbon sequestration," Sweden; N.p., https://www.osti.gov/etdeweb/biblio/985454; (2010).

Fillat, U. et al., "Assessing enzymatic deinking for secondary fibers paper recycling in the presence of flexographic inks," Chem. Eng. J., vol. 260; 486-491 (2015).

Franz, R., "Programme on the recyclability of food-packaging materials with respect to food safety considerations: Polyethylene terephthalate (PET), paper and board, and plastics covered by functional barriers," Food Addit. Contam., vol. 19; 93-110 (2002).

Garlotta, D., "A Literature Review of Poly(Lactic Acid)," J. Polym. Environ., vol. 9; 63-84 (2002).

Geueke, B. et al., "Food packaging in the circular economy: Overview of chemical safety aspects for commonly used materials," J. Clean. Prod., vol. 193; 491-505 (2018).

Gooljar, J. (2018). Fact sheet: How much disposable plastic we use, Retrieved from Internet URL: https://www. earthday.org/fact-sheet-how-much-disposable-plastic-we-use/ on Jan. 4, 2022; 5 pages.

Gu, L. and Ozbakkaloglu, T., "Use of recycled plastics in concrete: A critical review," Waste Manage., vol. 51; 19-42 (2016).

Han, S. et al., "Cellulose nanofibers from bamboo and their nanocomposites with polyvinyl alcohol: Preparation and characterization," Polym. Composite., vol. 39; 2611-2619 (2018).

Karamfilova, E., and Sacher, M. (2016). Food contact materials regulation (ec) 1935/2004 european implementation assessment. https://www.europarl.europa.eu/RegData/etudes/STUD/2016/581411/EPRS_STU(2016)58 1411 EN.pdf.

Kiatkittipong, W. et al., "Life cycle assessment of bagasse waste management options," Waste Manage., vol. 29; No. 5; 1628-1633 (2009).

Koh, J.J. et al., "Fully biodegradable poly (lactic acid)/starch blends: A review of toughening strategies," Int. J. Biol. Macromol., vol. 109; 99-113 (2018).

Leblanc, R. (2017). How long does it take garbage to decompose. https://recycling.about.com/od/Resources/fl/How-Long-Does-It-Take-Garbage-to-Decompose.

Le Phuong, H.A. et al., Non-woven membrane supports from renewable resources: bamboo fiber reinforced poly(lactic acid) composites. ACS Sustain. Chem. Eng., vol. 71; No. 13; 11885-11893 (2019).

(Continued)

*Primary Examiner* — Mark Halpern

(74) *Attorney, Agent, or Firm* — HAMILTON, BROOK, SMITH & REYNOLDS, P.C.

(57) ABSTRACT

Provided herein are mixed pulp compositions comprising a short fiber plant pulp (e.g., sugar cane bagasse) and a long fiber plant pulp (e.g. bamboo fiber). Also provided herein is a process for preparing the compositions.

17 Claims, 28 Drawing Sheets

(56) References Cited

OTHER PUBLICATIONS

Llanos, J.H.R. and Tadini, C.C., "Preparation and characterization of bio-nanocomposite films based on cassava starch or chitosan, reinforced with montmorillonite or bamboo nanofibers," Int. J. Biol. Macromol., vol. 107; 371-382 (2018).
Lindström, T. and Larsson, P.T., Alkyl ketene dimer (AKD) sizing—A review. Nord. Pulp. Pap. Res. J., vol. 23; 202-209 (2008).
Masni-Azian, A. et al., "Tensile properties evaluation of paper pulp packaging at different sections and orientations on the egg tray," Adv. Mater. Res., vol. 626; 542-546 (2013).
Morão, A. and de Bie, F. (2019). Life cycle impact assessment of polylactic acid (PLA) produced from sugarcane in Thailand, J. Polym. Environ., vol. 27; 2523-2539 (2019).
Nilsson, H. et al., "Compression molded wood pulp biocomposites: A study of hemicellulose influence on cellulose supramolecular structure and material properties," Cellulose, vol. 19; 751-760 (2012).
Panyakapo, P. and Panyakapo, M., "Reuse of thermosetting plastic waste for lightweight concrete," Waste Manage., vol. 28; 1581-1588 (2008).
Pennington, J. (2016). In Every minute, one garbage truck of plastic is dumped into our oceans, this has to stop, Retieved from Internet URL: https://www.weforum.org/agenda/2016/10/every-minute-one-garbage-truck-of-plastic-is-dumped-into-our-oceans on Jan. 4, 2022; 8 pages.
Ramos, J. et al., "Enzymatic and fungal treatments on sugarcane bagasse for the production of mechanical pulps," J. Agr. Food. Chem., vol. 52; 5057-5062 (2004).
Ross, S. and Evans, D., "The environmental effect of reusing and recycling a plastic-based packaging system," J. Clean. Prod., vol. 11; 561-571 (2003).
Tokiwa, Y. et al., Biodegradability of plastics. Int. J. Mol. Sci., vol. 10; 3722-3742 (2009).
Tyagi, P. et al., "Nanocellulose-based multilayer barrier coatings for gas, oil, and grease resistance," Carbohyd. Polym., vol. 206; 281-288 (2019).
Usda, F. (2017). Sugar: World markets and trade. https://www.fas.usda.gov/data/sugar-world-markets-and-trade, May 2017, 8 pages.
Usda, F. (2017). Sugar: World markets and trade. https://www.fas.usda.gov/data/sugar-world-markets-and-trade, Nov. 2017, 8 pages.
Verma, R. et al., "Toxic pollutants from plastic waste A review," Procedia Environ. Sci., vol. 35; 701-708 (2016).
Wang, Q. et al., "Effect of light-delignification on mechanical, hydrophobic, and thermal properties of high-strength molded fiber materials," Sci. Rep., vol. 8; 1-10 (2018).
Wang, X. et al., All-natural, degradable, rolled-up straws based on cellulose micro-and nano-hybrid fibers. Adv. Funct. Mater., vol. 30; 1910417-1910428 (2020).

* cited by examiner

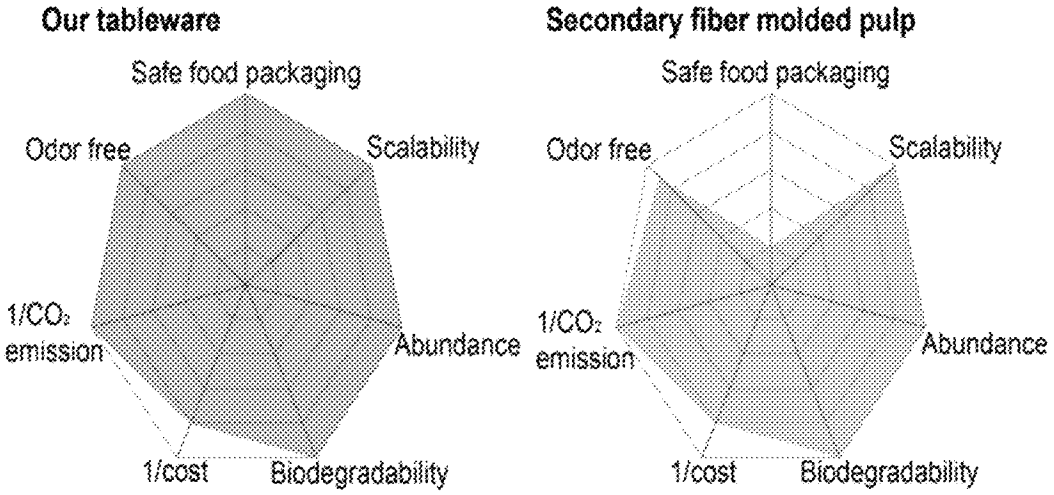
FIG. 13B
FIG. 13C
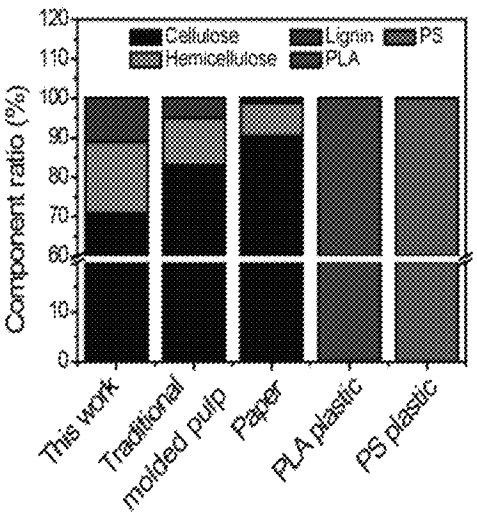
FIG. 13A

NATURAL FIBER COMPOSITES AS A LOW-COST PLASTIC ALTERNATIVE

RELATED APPLICATION

This application claims the benefit of U.S. Provisional Application No. 63/117,455, filed on Nov. 23, 2020. The entire teachings of this application are incorporated herein by reference.

BACKGROUND

Plastic made from fossil fuels has brought great convenience to our lives for its scalable manufacturing process, lightweight, robust mechanical properties, versatility, low cost, and the resistance to corrosion (Chandra, M., Kohn, C., Pawlitz, J., and Powell, G. (2016), Real cost of styrofoam. In Experiential Learning Project, Saint Louis University. https://greendiningalliance.org/wp-content/uploads/2016/12/real-cost-of-styrofoam_written-report.pdf). Plastic products have been widely used in various fields, such as packaging, food industry, electronics, construction, and many other industries; among which, about 16 billion disposable coffee cups are consumed every year and half a billion plastic straws are discarded every day in the world (Gu, L., and Ozbakkaloglu, T. (2016), Use of recycled plastics in concrete: A critical review. Waste Manage. 51, 19-42; Gooljar, J. (2018), Fact sheet: How much disposable plastic we use. https://www.earthday.org/fact-sheet-how-much-disposable-plastic-we-use/). However, it takes as long as 450 years or even longer for some plastics to degrade, especially single-use plastics, such as plastic bags, lunch boxes and disposable cups, accounting for 40 percent of the total plastic production and rendering severe "white pollution" (LeBlanc, R. (2017), How long does it take garbage to decompose. https://recycling.about.com/od/Resources/fl/How-Long-Does-It-Take-Garbage-to-Decompose). Meanwhile, every year about eight million tons of plastic wastes are dumped into oceans, which has caused significant harm to marine life. Current white pollution treatment includes landfilling, incineration, and recycling (Barnes, D. K., Galgani, F., Thompson, R. C., and Barlaz, M. (2009), Accumulation and fragmentation of plastic debris in global environments. Philos. Trans. R. Soc. Lond. B Biol. Sci. 364, 1985-1998; Panyakapo, P., and Panyakapo, M. (2008), Reuse of thermosetting plastic waste for lightweight concrete. Waste Manage. 28, 1581-1588; Chidambarampadmavathy, K., Karthikeyan, O. P., and Heimann, K. (2017), Sustainable bio-plastic production through landfill methane recycling. Renew. Sustain. Energ. Rev. 71, 555-562). Among which, the landfill treatment is the primary approach to handle single-use plastics, but it is difficult for plastics to degrade naturally, which causes water pollution and restriction for agriculture development. For plastic incineration, toxic substances produced such as fluorine, chlorine and carbides can deplete the ozone layer and harm human health. Waste plastic recycling is the best solution so far to reduce white pollution, but complex and high-cost treatments are generally involved, which has significantly hindered its development (Verma, R., Vinoda, K. S., Papireddy, M., and Gowda, A. N. S. (2016), Toxic pollutants from plastic waste—A review. Procedia Environ. Sci. 35, 701-708; Degnan, T., and Shinde, S. L. (2019), Waste-plastic processing provides global challenges and opportunities. MRS Bull. 44, 436-437). As a matter of fact, about 14% of the 78 million tons of plastic packaging produced last year were recycled and only 2% of the recycled plastics have been recycled into the same or similar-quality applications (Pennington, J. (2016), In Every minute, one garbage truck of plastic is dumped into our oceans, this has to stop. https://www.weforum.org/agenda/2016/10/every-minute-one-garbage-truck-of-plastic-is-dumped-into-our-oceans).

Tremendous efforts have been made to develop biodegradable materials to substitute conventional petroleum-derived plastics. Among the advancements, molded pulp products made from wood fibers and recycled papers have been sought after (Nilsson, H., Galland, S., Larsson, P. T., Gamstedt, E. K., and Iversen, T. (2012), Compression molded wood pulp biocomposites: A study of hemicellulose influence on cellulose supramolecular structure and material properties. Cellulose 19, 751-760; Chen, Y., Wan, J., Zhang, X., Ma, Y., and Wang, Y. (2012), Effect of beating on recycled properties of unbleached eucalyptus cellulose fiber. Carbohyd. Polym. 87, 730-736). Such molded pulp products are inherently biodegradable and have been used in packaging (Didone, M., Saxena, P., Brilhuis-Meijer, E., Tosello, G., Bissacco, G., McAloone, T. C., Pigosso, D. C. A., and Howard, T. J. (2017), Moulded pulp manufacturing: Overview and prospects for the process technology. Packag. Technol. Sci. 30, 231-249). Nevertheless, applying current molded pulp into food packaging is still highly challenging, which arises from the concerns of safety for food packaging and wet strength. First, most of the current molded pulps are made from secondary fiber, like newspapers and used books. Such secondary fiber generally contains residual inks and other chemicals due to incomplete deinking during the pulping process, which is undoubtedly a concern of safety for food packaging. Meanwhile, the application of current molded pulp is hindered by its poor performance regarding the low mechanical strength (11.25 MPa) and weak mechanical strength under oil and water (Masni-Azian, A., Choudhury, I. A., Sihombing, H., and Yuhazri, M. Y. (2013), Tensile properties evaluation of paper pulp packaging at different sections and orientations on the egg tray. Adv. Mater. Res. 626, 542-546). These poor performances could be attributed to the low quality of the fiber used for making molded pulp products. For example, the fibers from recycled paper are usually stiff and short, and it is hard to improve their external fibrillation by beating and drying. Developing molded pulp products that are safe for food packaging and have stable mechanical strength by using sustainable resources thus could open a significant pathway for replacing traditional food packaging.

Sugarcane represents one of the largest sugar sources worldwide. In 2017, the global production of sucrose from sugarcane amounted to 185 million tons, representing a 14.6 billion market (Usda, F. (2017), Sugar: World markets and trade. https://www.fas.usda.gov/data/sugar-world-markets-and-trade). However, the sucrose production also generates abundant bagasse as an industrial waste stream. For example, Brazil, as the world's largest sucrose producer, annually generates about 171 million tons of bagasse. Upgrading this large quantity of bagasse waste is thus one of the major challenging issues in the sugar industry. Bagasse is usually utilized for steam and power production for domestic sugar mills through incineration, landfill gas collection from landfilling, and biogas production through anaerobic decomposition, and a small portion of bagasse is used as pulp for paper manufacturing (Kiatkittipong, W., Wongsuchoto, P., and Pavasant, P. (2009), Life cycle assessment of bagasse waste management options. Waste Manage. 29, 1628-1633). However, the resultant sugarcane bagasse pulp often encounters low strength induced by its short fibers, which has significantly hindered the utilization of the sugarcane bagasse pulp (Ramos, J., Rojas, T., Navarro, F., Dávalos, F., Sanjuán, R., Rutiaga, J., and Young, R. A. (2004), Enzymatic and fungal treatments on sugarcane bagasse for the production of mechanical pulps. J. Agr. Food. Chem. 52, 5057-5062).

Accordingly, there remains a need for environmentally friendly and biodegradable alternatives to current plastics.

SUMMARY

Described herein are natural fiber composites that can be used, for example, as plastic alternatives.

Accordingly, provided herein are mixed pulp compositions comprising a short fiber plant pulp and a long fiber plant pulp.

Also provided herein is a mixed pulp composition comprising from about 60% to about 80% sugar cane bagasse and from about 20% to about 40% bamboo fiber.

Also provided herein is a process for preparing a mixed pulp composition described herein, the process comprising forming a dispersion of long fiber plant pulp and short fiber plant pulp in water, and drying the dispersion, thereby forming the mixed pulp composition.

The mixed pulp compositions described herein have exceptional performances, including full biodegradability, excellent water and oil resistance, superior mechanical strength, low carbon emission, high food safety, and low cost, as well as excellent processability and scalability. The mixed pulp compositions described herein thus represent a potential replacement of current plastic, e.g., plastic tableware for food packaging.

Example advantages of this work include: less energy consumption, high yield, low cost, turn waste in sugar industry to valuable materials, and can be recycled and remolded, biodegradable and compostable. In addition, example embodiments are cheap and compostable.

BRIEF DESCRIPTION OF THE DRAWINGS

The foregoing will be apparent from the following more particular description of example embodiments.

FIG. 13A shows a comparison of the components and ratio of molded pulp tableware in accordance with the instant disclosure with that of traditional molded pulp tableware, paper, polylactic acid (PLA) plastic, and PS plastic.

FIG. 13B is a radar plot of tableware in accordance with the instant disclosure.

FIG. 13C is a radar plot of traditional molded pulp tableware prepared using secondary fibers.

DETAILED DESCRIPTION

Figure 1:
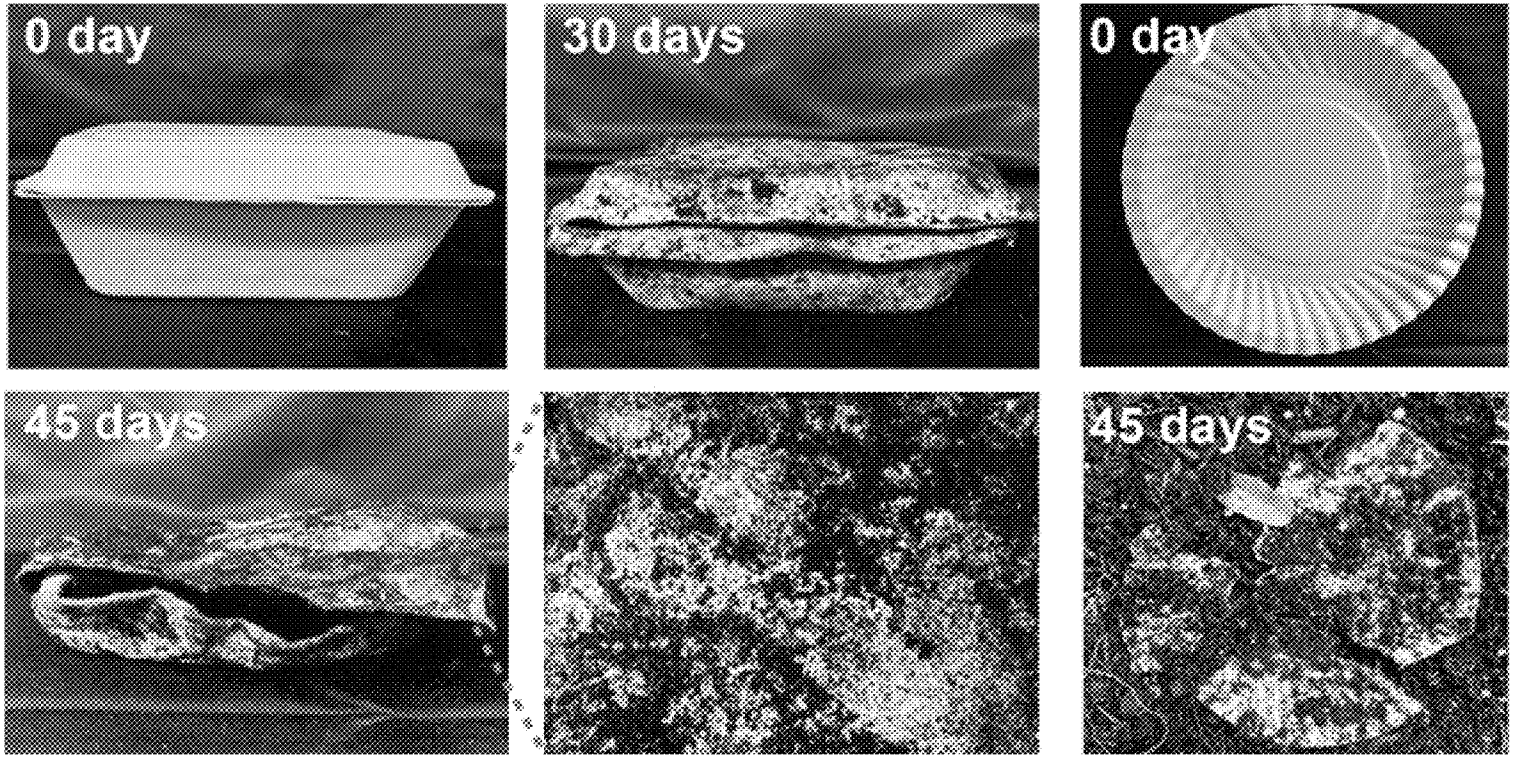
FIG. 1 shows photos of cellulose-based molded pulp lunch box and plate with different time of biodegradation showing shape deformation, fungi formation, and partial disappearance, which indicate promising biodegradation properties.

A description of example embodiments follows.

Compositions

It has been found that natural fiber composites (e.g., mixed plant pulp compositions described herein) can be used, for example, as plastic alternatives to provide, for example, low-cost, biodegradable, hygienic, and compostable replacements to plastics.

Accordingly, provided herein is a natural fiber composite comprising, consisting essentially of or consisting of at least two different plant pulps (e.g., a long fiber plant pulp, such as bamboo fiber, and a short fiber plant pulp, such as sugar cane bagasse).

As used herein, "plant pulp" refers to a lignocellulosic fibrous material. Plant pulp can be obtained as or from virgin biomass (e.g., biomass derived from biomatter that has been processed (e.g., chemically, mechanically processed) to separate the lignocellulosic fibrous material from wood or other fiber crop), waste biomass (e.g., biomass produced as a byproduct of an industrial process typically involving wood or a fiber crop, such as corn stover and sugar cane bagasse), and/or energy crops (e.g., a wood or fiber crop grown for energy production typically associated with high yields of plant pulp). Examples of fiber crops include, but are not limited to, ramie, corn, grass, sugar cane, flax, hemp, hoopvine, papyrus, pineapple leaves, agave, banana leaves, cotton, milkweed, yucca, coconut, switchgrass, elephant grass, and other crop by-products, such as sugar cane bagasse.

In some embodiments, the plant pulps, taken each individually or, preferably, together, contain less than 80% (e.g., from about 50% to less than 80%, from about 65% to about 75%, or from about 70% to about 75%) cellulose by weight. In some embodiments, the plant pulps, taken each individually or, preferably, together, contain greater than about 15% (e.g., from about 15% to about 30%, or from about 15% to about 20%) hemicellulose by weight. In some embodiments, the plant pulps, taken each individually or, preferably, together, contain greater than about 5% (e.g., from about 5% to about 15%, about 7.5% to about 12.5%, or about 10%) lignin by weight.

Also provided herein are mixed pulp compositions comprising a short fiber plant pulp and a long fiber plant pulp.

As used herein, the term "short fiber plant pulp" refers to a plant pulp comprising less than 2% fibers which are about three mm in length or greater. In some embodiments, a short fiber plant pulp comprises less than 1.75%, for example, less than 1.5%, less than 1.25%, less than 1%, about 1%, about 0.9%, about 0.8%, about 0.7%, about 0.6%, or about 0.5%, fibers which are about three mm in length or greater.

Examples of short fiber plant pulps include corn fiber, grass fiber, straw fiber and sugar cane fiber (e.g., bagasse). In some embodiments, the short fiber plant pulp comprises, consists essentially of, or consists of (e.g., comprises) corn fiber, grass fiber, straw fiber, or sugar cane fiber, or a combination of any of the foregoing. In some embodiments, the short fiber plant pulp comprises, consists essentially of, or consists of (e.g., comprises) sugar cane fiber. In some embodiments, the short fiber plant pulp comprises, consists essentially of, or consists of (e.g., comprises) sugar cane bagasse.

As used herein, the term "long fiber plant pulp" refers to a plant pulp comprising more than 2% fibers which are about three mm in length or greater. In some embodiments, the long fiber plant pulp comprises more than about 2.5% fibers which are about three mm in length or greater. In some embodiments, along fiber plant pulp comprises more than 2.5%, for example, more than 2.75%, more than 3.0%, more than 3.5%, about 4%, about 5%, about 6%, about 7%, about 8%, or about 10%, fibers which are about three mm in length or greater.

In some embodiments, the long fiber plant pulp comprises hemp fiber, wood fiber, flax seed fiber, or bamboo fiber, or a combination of any of the foregoing. In a particular embodiment, the long fiber plant pulp comprises, consists essentially of, or consists of bamboo fiber. In addition to bamboo fiber, other fibers can also or alternatively be used, e.g., to enhance mechanical strength at low cost, including flax fiber and hemp fiber.

It has been found to be advantageous for the short fiber plant pulp to have a greater average width than the long fiber plant pulp. Accordingly, in some embodiments, the average width of the short fiber plant pulp is 20 μm or greater, for example, greater than 22 microns, about 21 microns, about 22 microns, about 23 microns, about 24 microns, about 25 microns. In some embodiments, the average width of the short fiber plant pulp is 50 μm or less, for example, 40 μm or less, 30 μm or less, or 25 μm or less. Ranges incorporating any combination of the foregoing average widths are also contemplated. Thus, for example, in some embodiments, the average width of short fiber plant pulp is from 20 μm to 30 μm.

In some embodiments, the average width of the long fiber plant pulp is 20 μm or less. In some embodiments, the average width of the long fiber plant pulp is 19 μm or less, for example, about 18 microns, about 17 microns, about 16 microns, about 15 microns, about 14 microns, about 13 microns. In some embodiments, the average width of the long fiber plant pulp is 5 μm or greater, for example, 10 μm or greater, or 15 μm or greater. Ranges incorporating any combination of the foregoing average widths are also contemplated. Thus, for example, in some embodiments, the average width of long fiber plant pulp is from 10 μm to 20 μm.

Fiber length, percentage and average width can be measured by SEM or by optical microscope. For example, as described herein, the morphology and cross-section of molded pulp were characterized by a scanning electron microscope (S4800; Hitachi, Japan) with a working distance of 8 mm and a voltage of 5 kV. The molded pulp sample was sputter-coated to make the sample conductive, e.g., with a layer of gold-palladium (e.g., about 10 nm thick). Fiber morphology was also characterized with a perpendicular polarizing microscope (DM2700M; Leica Microsystems, Germany) and a fiber quality analyzer (FS-300; Kajaani, Finland).

Representative examples of fiber length distributions and/or average widths and/or weight average fiber lengths of short and long fiber plant pulps include those set forth in Table 1, and any combination thereof.

TABLE 1

| | Fiber length distribution (%) | | | | | |
|---|---|---|---|---|---|---|
| Sort | 0.2-0.5 mm | >0.5-1.5 mm | >1.5-<3.0 mm | 3.0-4.5 mm | $L_w$ (mm) | Width (μm) |
| Long fiber plant pulp (e.g., Bamboo pulp) | 35.8 | 47.2 | 13.9 | 3.1 | 0.895 | 18.6 |
| Short fiber plant pulp (e.g., Bagasse pulp) | 37.3 | 46.9 | 15.2 | 0.6 | 0.878 | 24.1 |

In an embodiment, the mixed pulp composition is in the form of a homogeneous mixture (e.g., a homogeneous solid, a homogeneous suspension).

In an embodiment, the mixed pulp composition is in solid form. For example, in an embodiment, the mixed pulp composition is in the form of an article of manufacture, such as tableware, a toy, a packing product, or a sanitary consumable, for example, a cup, plate, eating utensil, bowl, food container, toilet paper, paper towel, or facial tissue. Other suitable uses of the compositions described herein include one-time use food containers, such as a cup, plate, bowl, lunch box, and so on. Potential commercial applications include food packaging and other packaging.

In an embodiment, fibers from the long fiber plant pulp and fibers from the short fiber plant pulp are intertwined. As used herein, "intertwined" refers to physical interwinding of short fiber plant pulp and long fiber plant pulp (see, for example, FIGS. 10A-D and FIG. 12E). Although not wishing to be bound by any particular theory, it is believed that intertwining of short fiber plant pulp and long fiber plant pulp in the compositions described herein contributes to the high mechanical strength of the compositions. Intertwining can be observed, for example, by SEM.

In an embodiment, the mixed pulp composition comprises between about 10% short fiber plant pulp and about 90% short fiber plant pulp by weight. In an embodiment, the mixed pulp composition comprises between about 60% short fiber plant pulp and about 80% short fiber plant pulp by weight. In a particular embodiment, the mixed pulp composition comprises about 70% short fiber plant pulp by weight. For example, a mixed pulp composition can comprise about 10%, about 20%, about 30%, about 40%, about 50%, about 60%, about 70%, about 80%, or about 90% short fiber plant pulp by weight.

In an embodiment, the mixed pulp composition comprises between about 10% long fiber plant pulp and about 90% long fiber plant pulp by weight. In an embodiment, the mixed pulp composition comprises between about 20% long fiber plant pulp and about 40% long fiber plant pulp by weight. In a particular embodiment, the mixed pulp composition comprises about 30% long fiber plant pulp by weight. For example, a mixed pulp composition can comprise about 10%, about 20%, about 30%, about 40%, about 50%, about 60%, about 70%, about 80%, or about 90% long fiber plant pulp by weight.

Combinations of any of the aforementioned weight percentages are also envisioned. Thus, in an embodiment, the mixed pulp composition comprises about 10% short plant fiber plant pulp and about 90% long fiber plant pulp by weight. In an embodiment, the mixed pulp composition comprises about 20% short plant fiber plant pulp and about 80% long fiber plant pulp by weight. In an embodiment, the mixed pulp composition comprises about 30% short plant fiber plant pulp and about 70% long fiber plant pulp by weight. In an embodiment, the mixed pulp composition comprises about 40% short plant fiber plant pulp and about 60% long fiber plant pulp by weight. In an embodiment, the mixed pulp composition comprises about 50% short plant fiber plant pulp and about 50% long fiber plant pulp by weight. In an embodiment, the mixed pulp composition comprises about 60% short plant fiber plant pulp and about 40% long fiber plant pulp by weight. In an embodiment, the mixed pulp composition comprises about 70% short plant fiber plant pulp and about 30% long fiber plant pulp by weight. In an embodiment, the mixed pulp composition comprises about 80% short plant fiber plant pulp and about 20% long fiber plant pulp by weight. In an embodiment, the mixed pulp composition comprises about 90% short plant fiber plant pulp and about 10% long fiber plant pulp by weight. In some embodiments, the mixed pulp composition comprises from about 50% to about 90% short plant fiber plant pulp and about 10% to about 50% long fiber plant pulp by weight. In some embodiments, the mixed pulp composition comprises from about 60% to about 80% short plant fiber plant pulp and about 20% to about 40% long fiber plant pulp by weight. In some embodiments, the mixed pulp composition comprises from about 65% to about 75% short plant fiber plant pulp and about 25% to about 35% long fiber plant pulp by weight.

As used herein the term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower), e.g., 15 percent up or down, 10 percent up or down, 5 percent up or down, 4 percent up or down, 3 percent up or down, 2 percent up or down, or 1 percent up or down.

In an embodiment, the composition further comprises a paper sizing agent. Paper sizing agents are often used to decrease water absorption and thereby increase water resistance of paper and other cellulosic materials. In an embodiment, the paper sizing agent is rosin, alkyl ketene dimer, or alkenyl succinic dimer. In another embodiment, the paper sizing agent is an alkyl ketene dimer.

In an embodiment, the composition comprises from about 0.1% to about 10% by weight paper sizing agent, for example, about 0.1%, about 0.5%, about 1%, about 2%, about 3%, about 4%, about 5%, about 6%, about 7%, about 8%, about 9%, or about 10% by weight paper sizing agent. In an embodiment, the composition comprises from about 0.5% to about 5% by weight paper sizing agent. In an embodiment, the composition comprises from about 0.5% to about 1% by weight paper sizing agent.

In a specific embodiment, provided herein is a mixed pulp composition comprising from about 60% to about 80% sugar cane bagasse by weight and from about 20% to about 40% bamboo fiber by weight. In an embodiment, the mixed pulp composition further comprises from about 0.1% to about 5% alkyl ketene dimer by weight. In another embodiment, the mixed pulp composition comprises about 70% sugar cane bagasse, about 30% bamboo fiber, and from about 0.5% to about 1% alkyl ketene dimer by weight.

As will be appreciated by one of skill in the art, the relative percent ratios of sugar cane bagasse, bamboo fiber, and the paper sizing agent in any of the embodiments may be adjusted so that the sum of the weight percentages of the components is 100%.

Without wishing to be bound by any particular theory, it is believed that paper sizing agents, for example, AKD, react with the primary hydroxyl group of cellulose through esterification to form β-carbonyl ester linkages, thereby causing the hydrophobic group (long-chain alkyl group) to face away from the cellulose surface and to endow cellulose with a liquid-repellent property. Therefore, in some embodiments, the mixed pulp composition is hydrophobic. In some embodiments, the mixed pulp composition is liquid-repellent.

In an embodiment, the mixed pulp composition is biodegradable, such that, for example, the material completely degrades within the span of a decade or less and does not leave a lasting impact on the local environment.

In an embodiment, the mixed pulp composition is compostable, such that, for example, the complete biodegradation of the composition leaves behind humus that is full of nutrients suitable for growing plants.

In some embodiments, the mixed pulp composition is hygienic, such that, for example, it can be used as tableware and/or is free of inks, heavy metals or other chemicals deleterious to human health.

In an embodiment, the mixed pulp composition is at least about 40% decomposed after 60 days buried in soil, as measured, for example, by weight. In an embodiment, the mixed pulp composition is at least about 30% decomposed after 60 days buried in soil, as measured, for example, by weight. In an embodiment, the mixed pulp composition is at least about 20% decomposed after 60 days buried in soil, as measured, for example, by weight. In an embodiment, the mixed pulp composition is at least about 10% decomposed after 60 days buried in soil, as measured, for example, by weight.

Tensile testing, also known as tension testing, is a fundamental materials science and engineering test in which a sample is subjected to a controlled tension until failure. Properties that are directly measured via a tensile test are ultimate tensile strength, breaking strength, maximum elongation and reduction in area. From these measurements the following properties can also be determined: Young's modulus, Poisson's ratio, yield strength, and strain-hardening characteristics. Uniaxial tensile testing is the most commonly used method for measuring mechanical characteristics of isotropic materials. Tensile strength can be measured using a universal tensile testing machine (Instron Model 5567) with a displacement speed of 10 mm/min at room temperature.

In an embodiment, the tensile strength of the composition is greater than about 20 MPa, for example, as measured by universal uniaxial tensile testing at a displacement speed of about 10 mm/minute at room temperature for a sample of about 15 mm in length, about 3 mm in width, and about 0.6 mm in depth. In some embodiments, the tensile strength is from about 15 MPa to about 35 MPa. In some embodiments, the tensile strength is from about 15 MPa to about 25 MPa. In some embodiments, the tensile strength is 20 MPa or greater, for example, greater than about 21 MPa, about 22 MPa, about 23 MPa, about 24 MPa, or about 25 MPa. In an embodiment, the tensile strength is as measured by universal uniaxial tensile testing at a displacement speed of about 10 mm/minute at room temperature for a sample of about 15 mm in length, about 3 mm in width, and about 0.6 mm in depth In an embodiment, the composition has a Young's modulus of at least about 2 GPa, for example, as calculated by Young's modulus equation using the tensile strength as measured by universal uniaxial tensile testing at a displacement speed of about 10 mm/minute at room temperature for a sample of about 15 mm in length, about 3 mm in width, and about 0.6 mm in depth. In some embodiments, the Young's modulus is from about 1.5 GPa to about 3.5 GPa. In some embodiments, the Young's modulus is from about 1.5 GPa to about 2.5 GPa. In some embodiments, the average Young's modulus is 2.0 GPa or greater, for example, greater than about 2.1 GPa, about 2.2 GPa, about 2.3 GPa, about 2.4 GPa, or about 2.5 GPa. In an embodiment, Young's modulus is as calculated by Young's modulus equation using the tensile strength as measured by universal uniaxial tensile testing at a displacement speed of about 10 mm/minute at room temperature for a sample of about 15 mm in length, about 3 mm in width, and about 0.6 mm in depth. Young's modulus equation is E=tensile stress/tensile strain=(FL)/(A*change in L), where F is the applied force, L is the initial length, A is the square area, and E is Young's modulus in Pascals (Pa). Using a graph, it can determine whether a material shows elasticity.

In an embodiment, the composition has a loadability of more than about 4%, for example, as measured by universal uniaxial tensile testing at a displacement speed of about 10 mm/minute at room temperature for a sample of about 15 mm in length, about 3 mm in width, and about 0.6 mm in depth. In some embodiments, the loadability is from about 1% to about 5%. In some embodiments, the loadability is from about 2% GPa to about 4% GPa. In some embodiments, the average loadability is 2% or greater, for example, greater than about 2.5%, about 3.0%, about 3.5%, about 4%, about 4.5%. In an embodiment, loadability is as measured by universal uniaxial tensile testing at a displacement speed of about 10 mm/minute at room temperature for a sample of about 15 mm in length, about 3 mm in width, and about 0.6 mm in depth.

To determine loadability or "compression load bearing performance," a sample can be subjected to 3 kg of weight for one minute, and the difference in height measured. The following formula for calculating compression load bearing performance of a sample can be used:

$$W=[(H_0-H)/H_0]\times 100\%,$$

where W is the compression loadability of the sample, $H_0$ (mm) is the height of the sample without load, H (mm) represents the height of a sample under a load for one minute. The larger the loadability value, the worse the compression load-bearing performance.

In an embodiment, the composition has a wet tensile strength of at least about 5.0 MPa, for example, as measured by universal uniaxial tensile testing at a displacement speed of about 10 mm/minute at room temperature for a sample of about 15 mm in length, about 3 mm in width, and about 0.6 mm in depth after soaking in water for about 8 hours.

Grease resistance can be measured using the TAPPI Test Method T559. Fluorochemical agents may impart both organophobic and hydrophobic characteristics to paper through a reduction in the surface energy of the sheet. This is often done by a surface treatment of fibers without the formation of continuous films. This test was originally developed to allow papermakers to know when the applied fluorochemical was incorporated into the sheet and the approximate level of desired grease resistance imparted. Testing involves placing a series of numbered reagents (varying in surface tension and viscosity or "aggressiveness") onto the surface of the sample. The solutions are numbered from 1 (least aggressive) to 12 (most aggressive).

In an embodiment, the composition has grease resistance of level 2 or higher, e.g., level 3 or higher, level 4 or higher, level 5 or higher, for example, as measured by grease resistance standard of Technical Association of the Pulp and Paper Industry T559. In an embodiment, the composition has grease resistance of level 5 or higher, as measured by grease resistance standard of Technical Association of the Pulp and Paper Industry T559.

A simple way of measuring the contact angle of a sessile drop is with a contact angle goniometer, which allows a user to measure a contact angle visually. A droplet is deposited by a syringe which is positioned above a sample surface, and a high-resolution camera captures the image from the profile or side view. The image can then be analyzed either by eye (with a protractor) or more often by image analysis software. This type of measurement is referred to as a static contact angle measurement. Typically, a higher contact angle is indicative of a more hydrophobic surface.

In an embodiment, the composition has a contact angle of greater than about 100°, for example, as measured by static sessile drop method using a contact angle goniometer with water as the solvent at room temperature. In some embodiments, the contact angle is from about 100° to about 140°. In some embodiments, the contact angle is from about 115° to about 130°. In some embodiments, the average contact angle is 100° or greater, for example, greater than about 110°, about 115°, about 120°, about 125°, or about 130°. In an embodiment, contact angle is as measured by static sessile drop method using a contact angle goniometer with water as the solvent at room temperature.

Water-absorption test is a test to determine the moisture content of a material as a percentage of its dry weight. The sample is weighed when dry, subjected to a period of immersion (e.g., 1 hour) in water or another liquid, and then weighed again. The relative water absorption can be calculated according to the following formula:

$$A = \frac{(m_2 - m_1)}{m_1} \times 100\%,$$

where A is the relative water absorption (%), $m_1$ represents the mass of the sample before absorbing liquid, and $m_2$ represents the mass of the sample after absorbing liquid.

In an embodiment, the composition has water absorption of less than about 75%, for example, as measured by immersion of a 100 mm×100 mm sample in water for about one hour. In some embodiments, the water adsorption is from about 75% to about 150%. In some embodiments, the water adsorption is from about 75% to about 100%. In some embodiments, the water adsorption is 75% or less, for example, less than about 74%, about 73%, about 72%, about 71%, about 70%. In an embodiment, water absorption is as measured by immersion of a 100 mm×100 mm sample in water for about one hour.

In an embodiment, the composition meets the industry standard for lead and arsenic content in food packaging material according to the Food Contact Materials Regulation No. 1935/2004.

Process of Preparation

Also provided herein are processes for preparing the compositions described herein. In one embodiment, the process comprises forming a dispersion (e.g., a homogeneous dispersion) of long fiber plant pulp (e.g. bamboo fiber) and short fiber plant pulp (e.g., sugar cane fiber, such as sugar cane bagasse) in water; and drying the dispersion, thereby forming the mixed pulp composition. In another embodiment, the dispersion further comprises a paper sizing agent, including any of the paper sizing agents described herein. Media other than water can be used to form a dispersion herein, but water is preferred for being a low-cost and eco-friendly medium.

In an embodiment, the process further comprises concentrating the dispersion to form a concentrated dispersion (e.g., a homogeneous concentrated dispersion). In another embodiment, the process further comprises cold-pressing the dispersion or the concentrated dispersion to form a cold-pressed dispersion. In a further embodiment, the process further comprises hot pressing the cold-pressed dispersion into a form, thereby drying the dispersion.

Alternatively, a dispersion or concentration dispersion can be printed into a form, e.g., using a 3D printer. Thus, in some embodiments, the process comprises printing the dispersion or concentrated dispersion into a form, e.g., with a 3D printer.

EXEMPLIFICATION

Example 1. Biodegradable, Hygienic, and Compostable Tableware from Hybrid Sugarcane and Bamboo Fibers as Plastic Alternative Abstract. In this study, a pathway to valorize sugarcane bagasse left from sugar production to food-related end-products through pulp molding, which represents a sustainable material and clean manufacturing was developed. The sugarcane bagasse from sugar industry is naturally safe for food-related applications. The produced tableware is fully biodegradable, renewable, and environment-friendly. Also developed was a hybrid fiber strategy that long bamboo fibers were blended with short sugarcane fibers, which formed abundant physical interwinding in the obtained tableware with superior performances as required for food container, including high tensile strength, superior oil stability, excellent hydrophobicity, and low heavy-metal content. Noteworthy, the tableware was mostly biodegraded under natural conditions within 60 days, which is largely shorter than degradation time for synthetic plastics. Moreover, in comparison with polystyrene production, pulp molding had much less $CO_2$ emission. The tableware made from biomass thus represents an eco-friendly and biodegradable alternative of synthetic plastics toward food packaging.

Introduction. To address the challenge in sugarcane bagasse utilization, this work has developed a fiber hybridization strategy by blending long bamboo fibers with the short sugarcane bagasse fibers. The long bamboo fibers possess the advantages of long fibers, high mechanical strength, antivirus properties, and cost-effectiveness, and the short sugarcane bagasse fibers can physically interwind with the long bamboo fibers to form a tightly interacted network that further enhances the mechanical properties of the derived end products. Besides, in comparison with most trees, the growth period of bamboo is much shorter, and its processability is generally better. Tremendous efforts have been put to develop bamboo composites in various advanced fields, such as membrane, aerogels, biofilms, and catalyst (Phuong, H. A. L., Ayob, N. A. I., Blanford, C. F., Rawi, N. F. M., and Szekely, G. (2019), Non-woven membrane supports from renewable resources: bamboo fiber reinforced poly(lactic acid) composites. ACS Sustain. Chem. Eng. 7, 11885-11893; Han, S., Yao, Q., Jin, C., Fan, B., and Zheng, H. (2018), Cellulose nanofibers from bamboo and their nanocomposites with polyvinyl alcohol: Preparation and characterization. Polym. Composite. 39, 2611-2619; Lianos, J. H. R., and Tadini, C. C. (2018), Preparation and characterization of bio-nanocomposite films based on cassava starch or chitosan, reinforced with montmorillonite or bamboo nanofibers. Int. J. Biol. Macromol. 107, 371-382; de Sá, D. S., de Andrade Bustamante, R., Rocha, C. E. R., da Silva, V. D., da Rocha Rodrigues, E. J., Müller C. D. B., Ghavami, K., Massi, A., and Pandoli, O. G. (2019), Fabrication of lignocellulose-based microreactors: Copper-functionalized bamboo for continuous-flow click reactions. ACS Sustain. Chem. Eng. 7, 3267-3273). All these inherent features make bamboo fiber a potential alternative of wood fiber to strengthen sugarcane bagasse pulp.

In this work, it was sought to develop quality molded pulp with food safety, superior mechanical strength, and water and oil stability as an environmentally friendly, fully-biodegradable, recyclable, and compostable tableware to replace the traditional plastics used for food packaging. Sugarcane bagasse wastes remaining from sugar industry were used as a renewable and food-safe feedstock to prepare the pulp first. The long bamboo fibers were subsequently added to enhance the mechanical strength of the sugarcane bagasse pulp. In addition, to improve the oil and water resistance of molded pulp products, a cost-effective and eco-friendly chemical, alkyl ketene dimer (AKD), was used to modify cellulose microfibers.

Figure 9A:
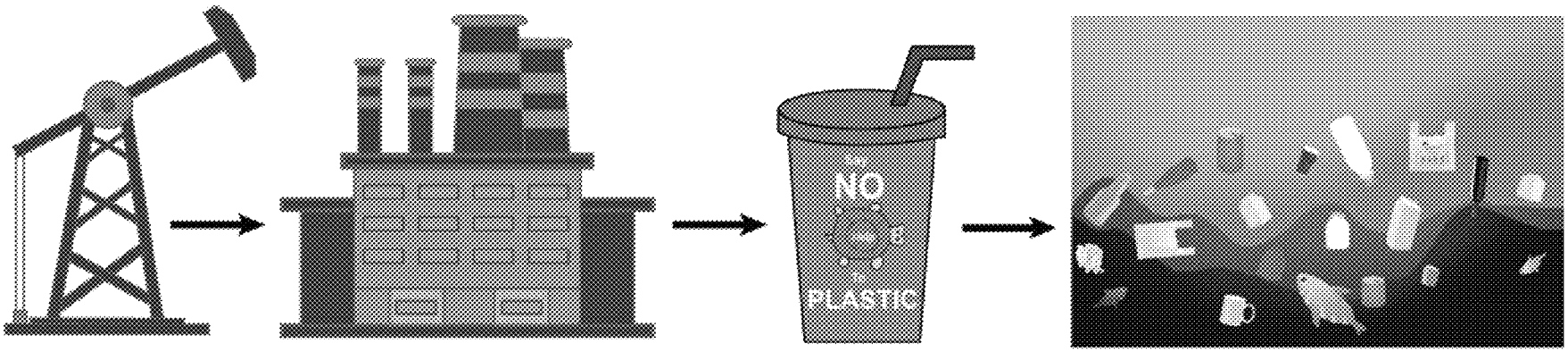
FIG. 9A shows a schematic illustration of plastic manufacturing from petroleum refining.
Figure 9B:
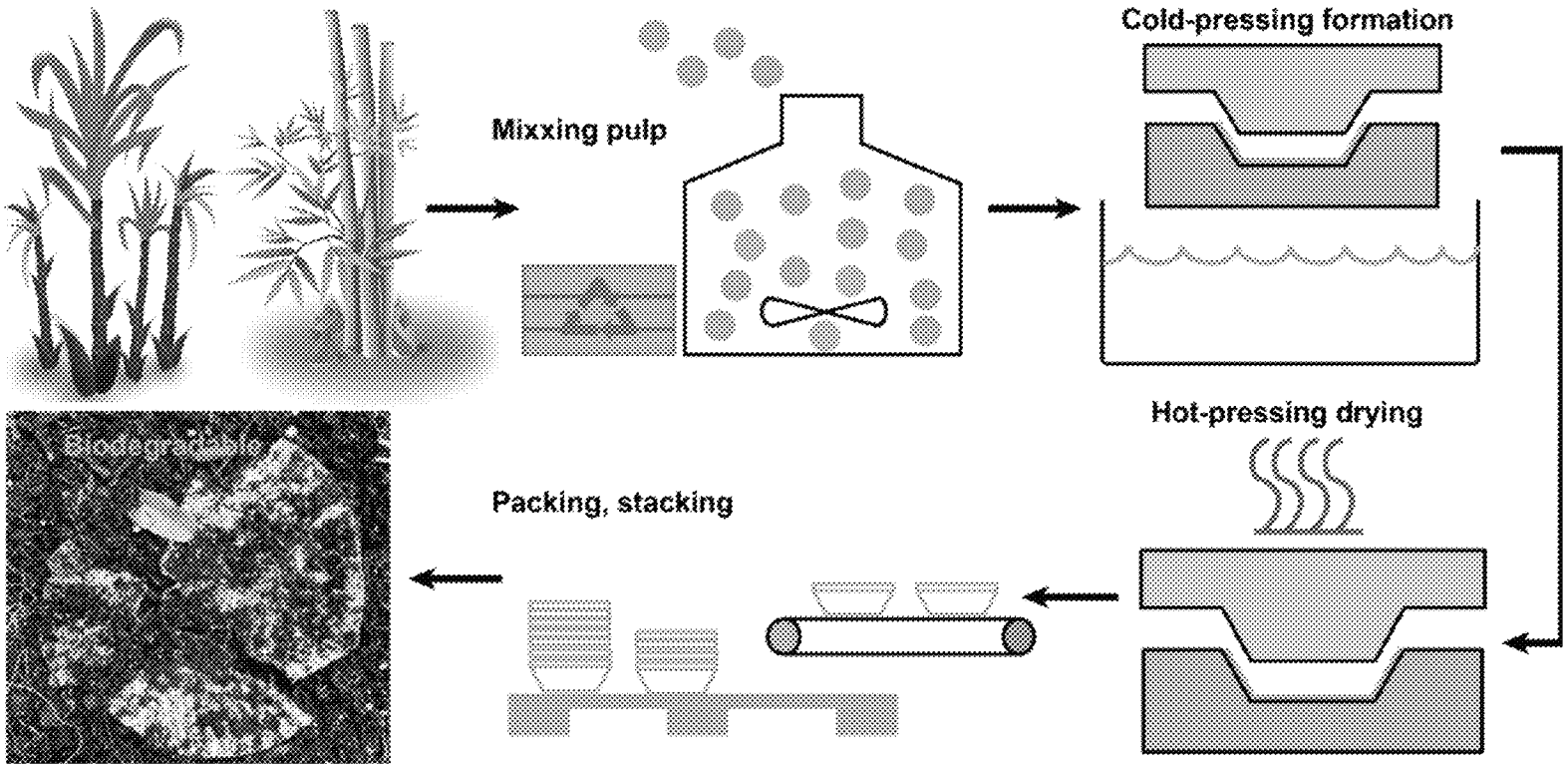
FIG. 9B shows a schematic illustration of molded pulp manufacturing using sugar cane bagasse and bamboo fibers to produce biodegradable tableware as an alternative of plastics used in food industry.

Results and Discussion. Petroleum refining has established vast platforms to produce plastic products (FIG. 9A), which has become essential part of our daily life. Along with the convenience the plastics have brought us, the increased plastic production causes severe environmental pollutions. A large number of plastic wastes have flowed into the ocean from land and accumulated in the food chain, which is undoubtedly a threat to both terrestrial and marine lives (FIG. 9A). In this work, renewable and biodegradable natural fibers from lignocellulosic biomass as feedstock for producing pulps to manufacture green tableware as an alternative of plastic for food packaging was used (FIG. 9B). A fiber hybridization strategy was used to blend the long bamboo fibers with the short sugarcane bagasse fibers, which formed a highly interwound composite that bamboo fibers embed in the sugarcane bagasse fiber matrix and serve as the reinforcer. The manufacturing process mainly included mixing sugarcane bagasse fibers with bamboo fibers, cold pressing formation, hot pressing drying, and packing (FIG. 9B). With the same raw materials and the developed process, different mold shapes and various containers can be manufactured, such as cup, box, and plate. This manufacturing has utilized the waste of the sugar industry to make tableware, which is clean, hygienic, and under the requirement of the food-related products. The processing represents a green and sustainable conversion of the raw materials from nature into food containers with superior biodegradability (FIG. 9B).

Figure 10B:
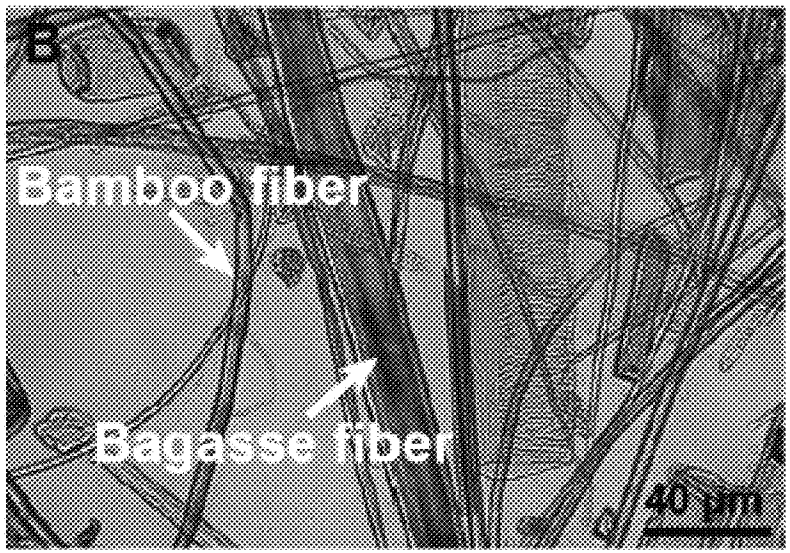
FIG. 10B is an optical microscopic image of mixed fibers (bagasse and bamboo fibers) at a higher magnification than used for FIG. 10A.
Figure 10A:
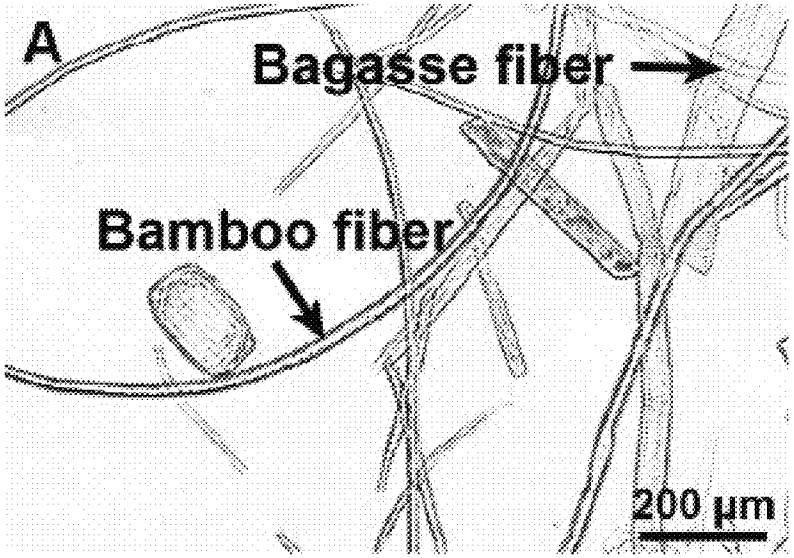
FIG. 10A is an optical microscopic image of mixed fibers (bagasse and bamboo fibers) at one magnification.

First, the morphology of the mixed fibers and the degradation properties of the molded pulp were investigated. As shown in FIG. 10A and FIG. 10B, two different types of fibers can be well defined in the pulp. The relatively wider and shorter fibers were derived from sugarcane bagasse pulp and the finer and elongated fibers were derived from bamboo pulp. Furthermore, as shown in Table 1A, the analyses of fiber distribution displayed that the percentage of long fibers (3.0-4.5 mm) in bamboo pulp (3.1%) was significantly higher than that in bagasse pulp (0.6%), but the average fiber width (18.6 μm) of bamboo fiber was considerably smaller than that of bagasse fiber (24.1 μm). These mixed fibers can not only be more cost-effective than using only bamboo pulp or wood pulp but also ensure the mechanical properties of the composite.

TABLE 1A

| | Fiber length distribution (%) | | | | | |
|---|---|---|---|---|---|---|
| Sort | 0.2~0.5 mm | 0.5~1.5 mm | 1.5~3.0 mm | 3.0~4.5 mm | $L_w$ (mm) | Width (μm) |
| Bamboo pulp | 35.8 | 47.2 | 13.9 | 3.1 | 0.895 | 18.6 |
| Bagasse pulp | 37.3 | 46.9 | 15.2 | 0.6 | 0.878 | 24.1 |

Figure 10C:
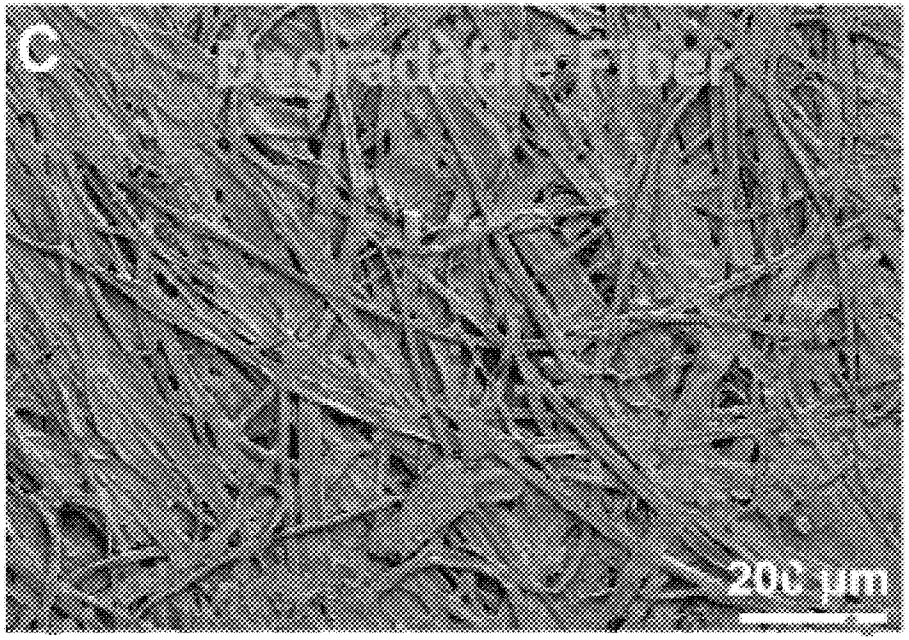
FIG. 10C is a scanning electron microscope (SEM) image of surface morphology of a molded pulp cup at one magnification.
Figure 10E:
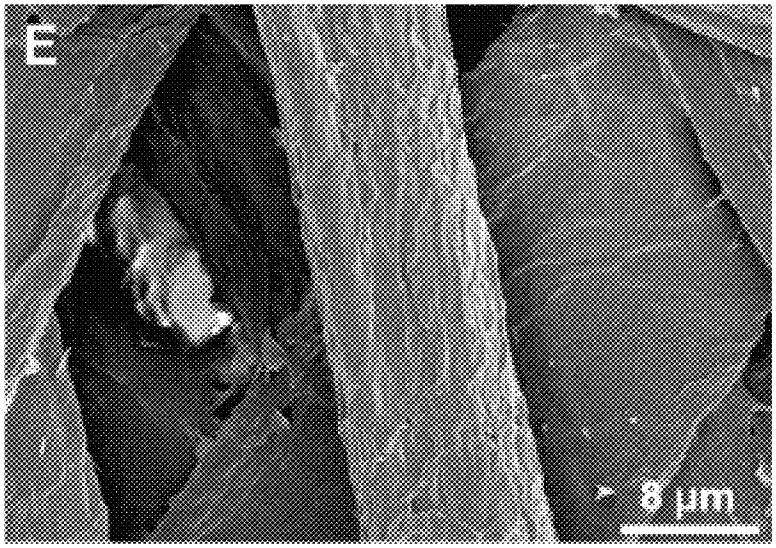
FIG. 10E is a SEM image of surface morphology of a molded pulp cup at a higher magnification than used for FIG. 10D.
Figure 10D:
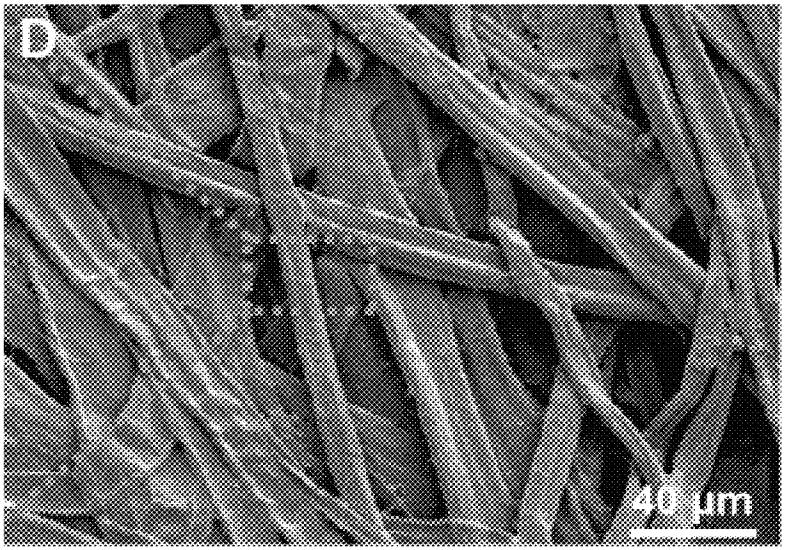
FIG. 10D is a SEM image of surface morphology of a molded pulp cup at a higher magnification than used for FIG. 10C.
Figure 10F:
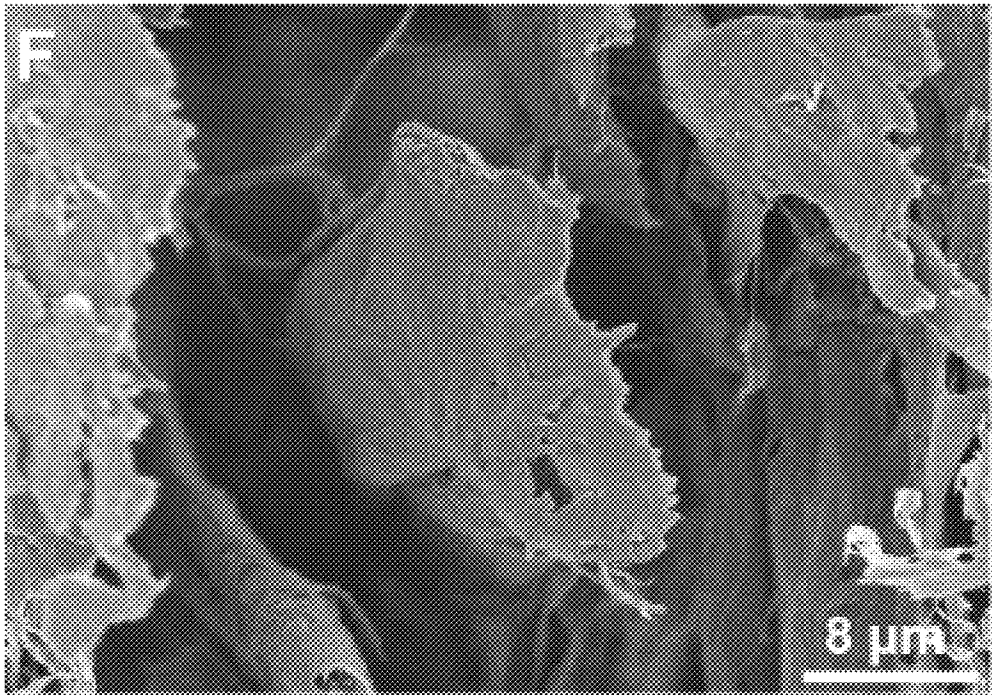
FIG. 10F is a SEM image of the cross-section of the fibers in the molded pulp cups.
Figure 10G:
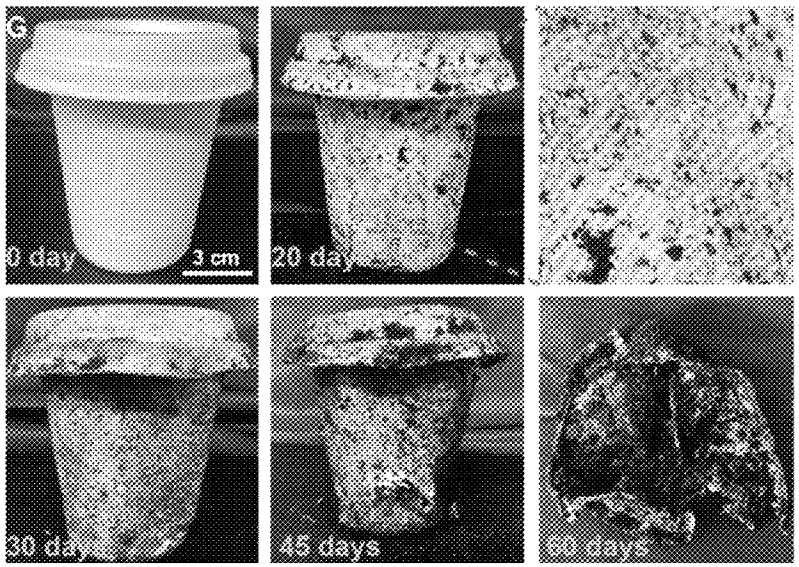
FIG. 10G shows photo images of molded pulp cup displayed high biodegradation properties as compared to those of the plastic lunchbox shown in FIG. 10H.
Figure 10H:
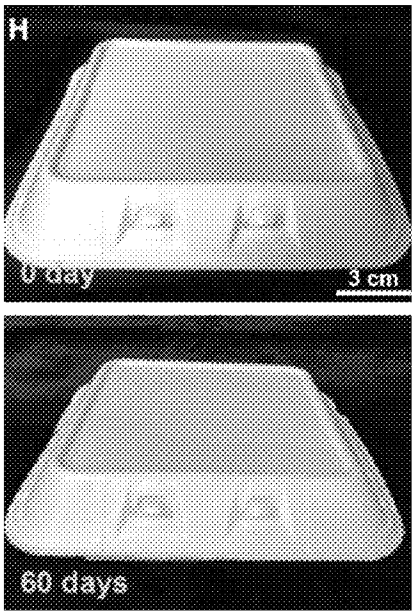
FIG. 10H shows photo images of a plastic lunchbox.

FIGS. 10C-F show the scanning electron microscope (SEM) images of both surface and cross section of molded pulp cup. The fibers were bonded together by some adhesive substance which improved binding compactness between fibers (FIG. 10C). These adhesive substances were mainly caused by the phase transition of the residual lignin in the pulp during hot pressing and the increased hydrogen bonding between cellulose inside the pulp during compression. Meanwhile, lignin is a hydrophobic polymer and provides mechanical stiffness to the wood; the residual lignin thus contributes to the water resistance and stiffness of the resultant tableware. In addition, SEM further confirmed that these fibers are composed of wide fibers and elongated fibers (FIG. 10D and FIG. 10E). Because the sugarcane bagasse pulp as aforementioned contains many short fibers, this hybrid pulp can improve the mechanical properties of molded pulp products. From the cross section of the molded pulp tableware (FIG. 10F), the entangled three-dimensional (3D) network of pulp fibers exists some small cavities between neighboring fibers, which make the molding materials possess both high mechanical strength and lightweight.

Figure 2:
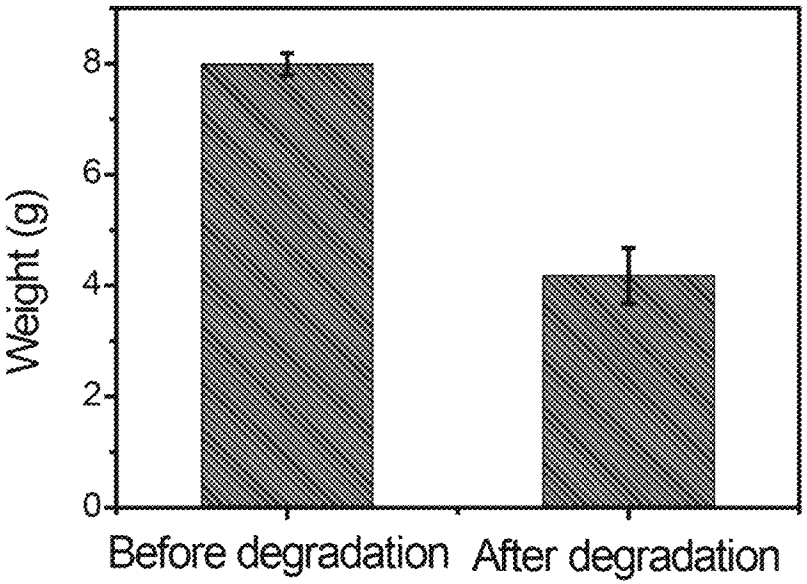
FIG. 2 shows the dry weight of molded pulp cup before and after 60 days burying.
Figure 12B:
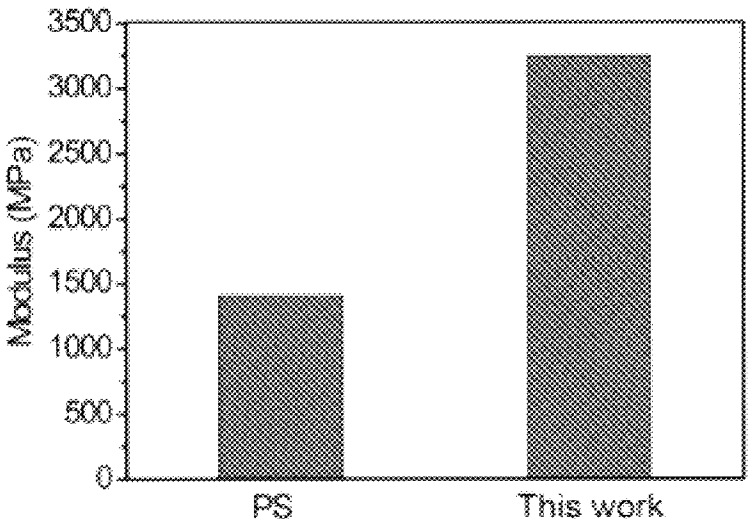
FIG. 12B shows the Young's Modulus of molded pulp cup and PS plastic cup.
Figure 12A:
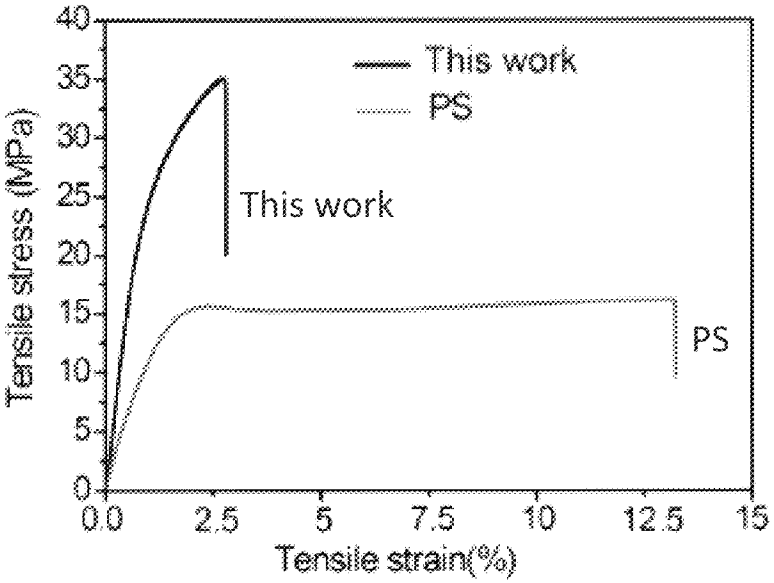
FIG. 12A shows the tensile strength of molded pulp cup and PS plastic cup.
Figure 12C:
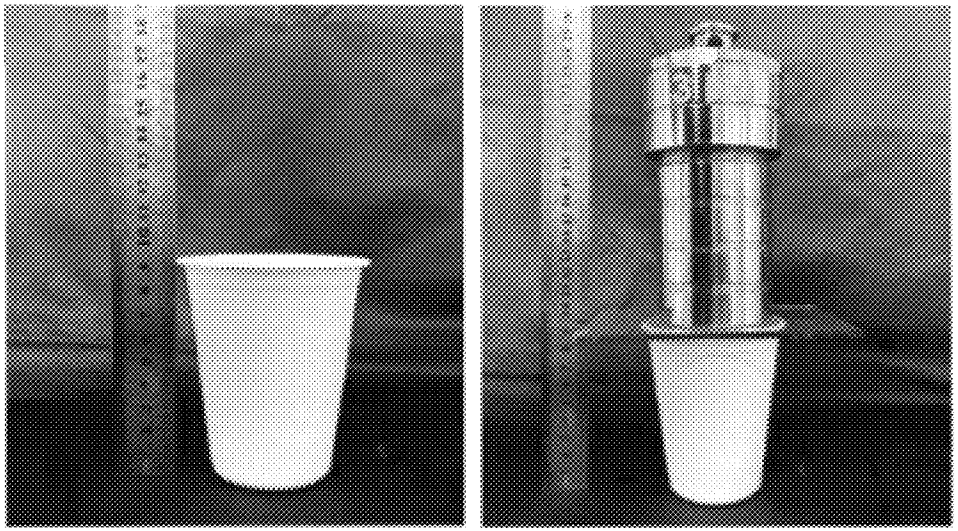
FIG. 12C shows images of molded plant cup with and without load.
Figure 12D:
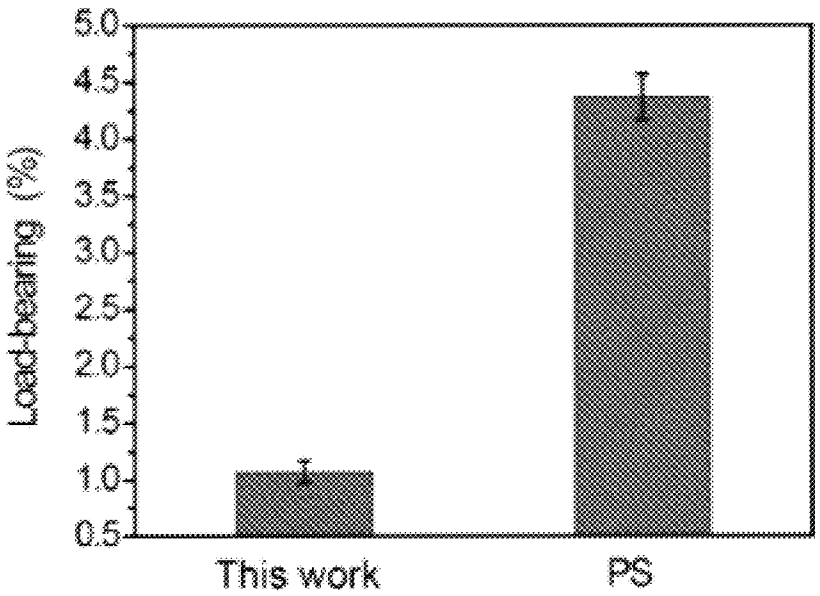
FIG. 12D shows load-bearing tests of molded pulp cup showed high stiffness.
Figure 12E:
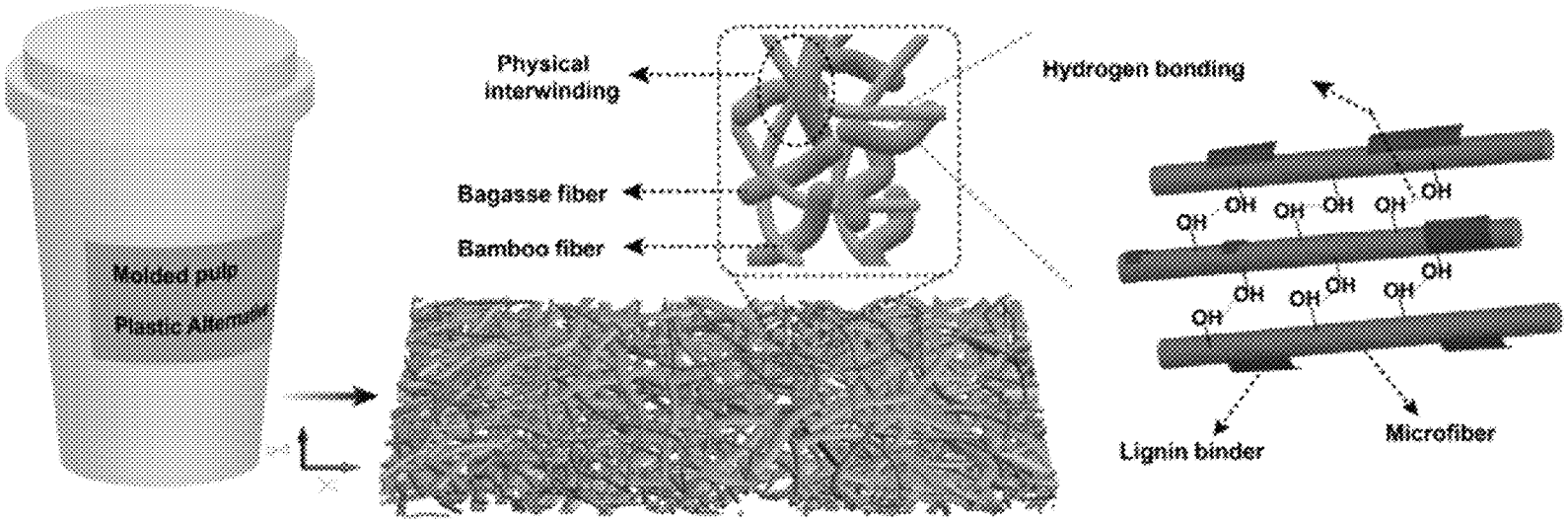
FIG. 12E is a schematic illustration of the mechanism of the good mechanical properties of molded pulp with hybrid fibers.
Figure 12F:
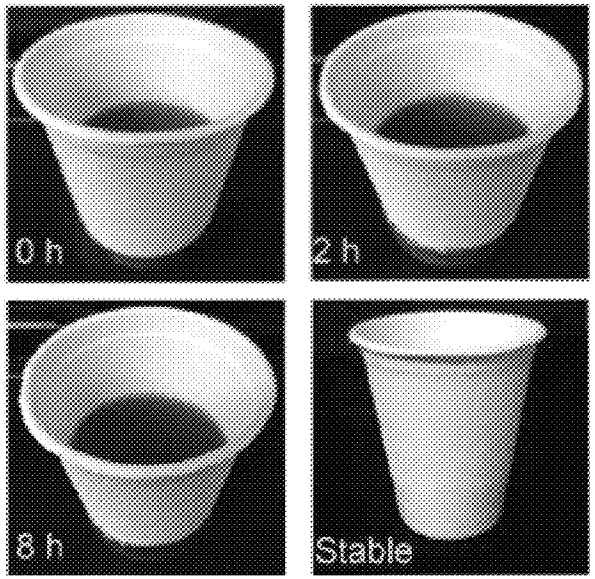
FIG. 12F shows photo images of molded pulp cup soaking in colored water showed good water stability after 8-hour immersion.
Figure 12G:
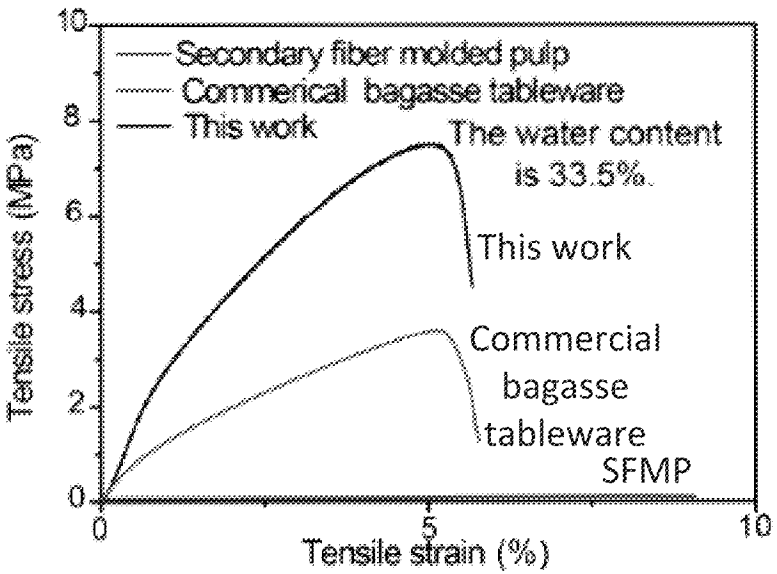
FIG. 12G shows wet mechanical strength of molded pulp cup, secondary fiber molded pulp, and commercial bagasse tableware. The water content of all samples was controlled at about 33.5%.

Plastics made from petroleum refinery are extremely difficult to degrade under the natural environment. In addition, petroleum resources are non-renewable and continuous use can lead to its depletion one day. Meanwhile, petroleum-based materials possess severe environmental challenges. Even though some biodegradable polymers such as polylactic acid (PLA) have practical developments, their degradation normally requires a specifically high temperature and takes a long time. Cost-effective and sustainable production of highly biodegradable molded pulp materials thus has great potential to serve as the next generation plastic substitutes. Unlike plastic, some lignocellulosic biomasses are common nutrition for many microorganisms, insects and animals, such as bacteria, locusts, cattle and sheep. The resultant biodegradation products of the pulp fibers are non-toxic and environmentally benign. To evaluate the biodegradability of molded pulp tableware, they were buried into a natural soil and checked the changes in their morphologies and weights. As shown in FIG. 1 and FIG. 12G, after 20 days burying, yellow fungi can be found on the surface of molded pulp tableware. After 30 to 45 days burying, the tableware started to deform. After burying for 60 days, pristine molded pulp totally lost its shape and gradually disappeared. Meanwhile, the dry weight of molded pulp cup before and after 60 days burying was 7.99 g and 4.18 g, respectively (FIG. 2), suggesting that almost half of the molded cup had been degraded. In contrast, after washing the surface of the PS plastic tableware, there was no significant change of its shape and surface after 60 days burying (FIG. 12H). These results proved that the molded pulp had much better biodegradability than the conventional PS plastic.

Figure 11A:
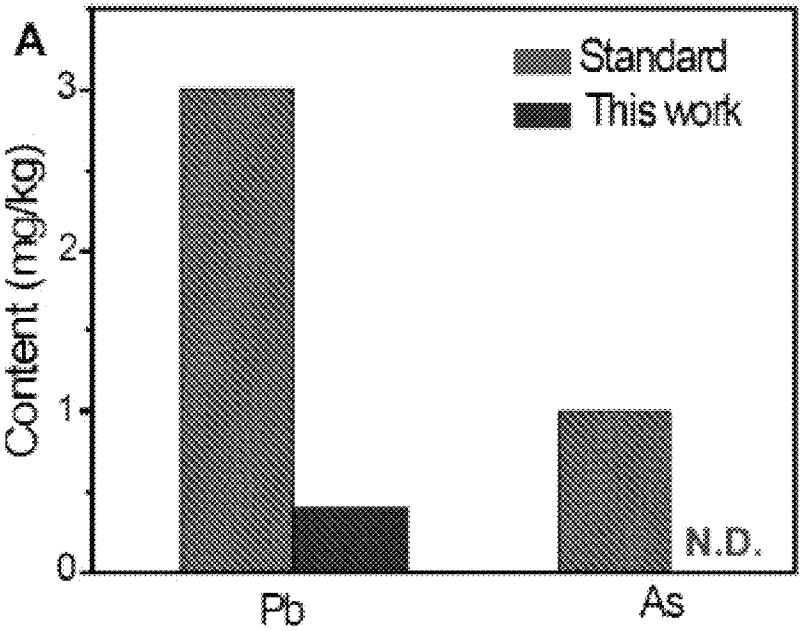
FIG. 11A shows heavy metals and water and oil resistances of molded pulp tableware, in particular, the contents of heavy metals (Pb and As) as compared to that required by Food Contact Materials Regulation (EC) No 1935/2004.

The performances of the molded pulp as food tableware were evaluated. First, food safety is the top request for food containers. Heavy metals existed in food container could be harmful to human health and have been regulated under the Food Contact Materials Regulation (EC) No 1935/2004 and National Food Safety Standard-Food Contact Paper and Board Materials and Their Products (English Version) GB 4806.8-2016, which the heavy metal contents of Pb and As should be below 3.0 mg/Kg and 1.0 mg/Kg, respectively. As characterized by an inductively coupled plasma-optical emission spectrometry (ICP-OES), the molded pulp tableware had a Pb content of 0.3633 mg/kg, while no As has been detected (FIG. 11A). These data demonstrated the safety of the molded pulp as a food container.

Second, oil and water resistances are the other two critical requirements for food tableware, both of which could ensure the physicochemical and mechanical properties of food tableware to protect the food quality and safety. To improve the water and oil resistances of molded pulp, AKD was added in the pulp to efficiently change the hydrophilicity of cellulosic fibers into hydrophobicity (see experimental section). For the oil resistance, grease resistance as defined by the standard of the Technical Association of the Pulp and Paper Industry (TAPPI) 559 pm-96 represents the resistance of the oil at the room temperature (Table 2), which is numbered from 1 (the least aggressive) to 12 (the most aggressive).

TABLE 2

12 degrees of solutions with different ratios of castor oil, toluene and n-heptane using for grease resistance tests.

| Kit No. | Castor oil (g) | Toluene (ml) | n-heptane (ml) |
|---|---|---|---|
| 1 | 969.0 | 0 | 0 |
| 2 | 872.1 | 50 | 50 |
| 3 | 775.2 | 100 | 100 |
| 4 | 678.3 | 150 | 150 |
| 5 | 581.4 | 200 | 200 |
| 6 | 484.5 | 250 | 250 |
| 7 | 387.6 | 300 | 300 |
| 8 | 290.7 | 350 | 350 |
| 9 | 193.8 | 400 | 400 |
| 10 | 96.9 | 450 | 450 |
| 11 | 0 | 500 | 500 |
| 12 | 0 | 450 | 550 |

Figure 3:
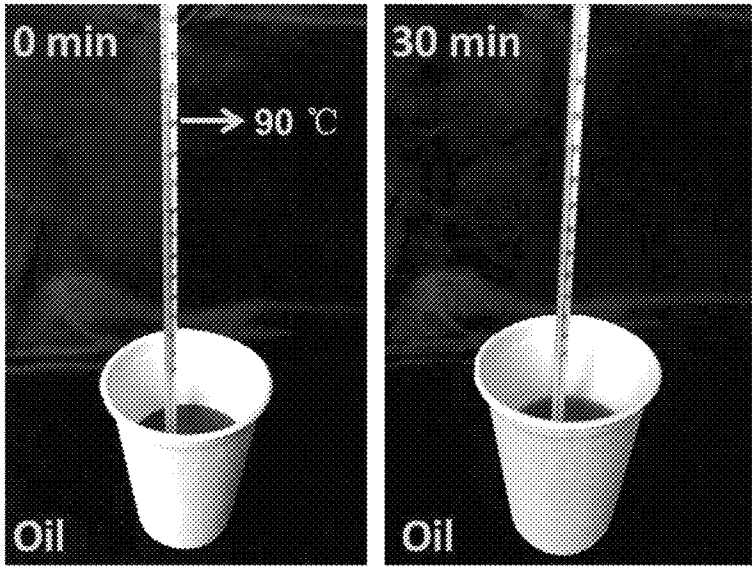
FIG. 3 shows photos of molded pulp cup showing good shape stability after containing hot oil with a temperature of 90° C. for 30 minutes, which indicates good hot oil resistance.
Figure 11B:
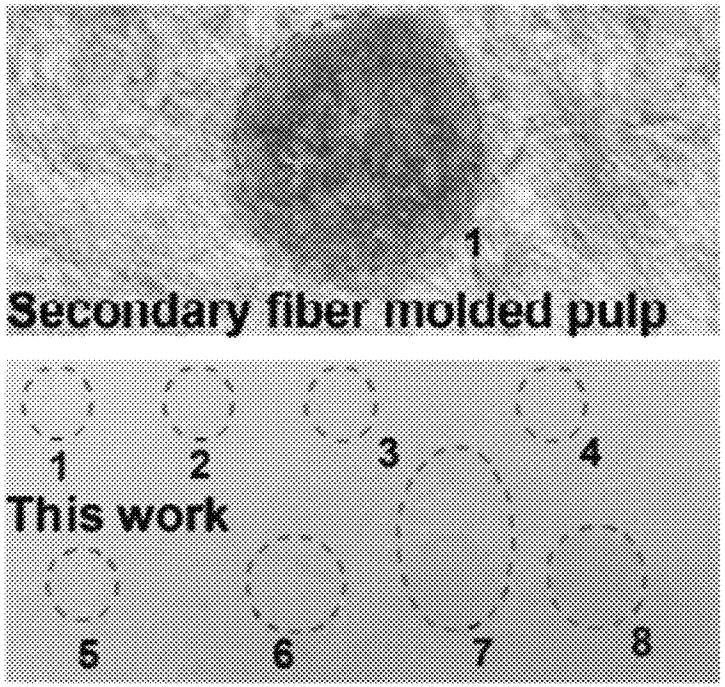
FIG. 11B are images of filter paper (top left image), bagasse tableware (bottom left image), commercial egg tray (top right image), and molded pulp tableware (bottom right image), and show oil resistance.
Figure 11B:
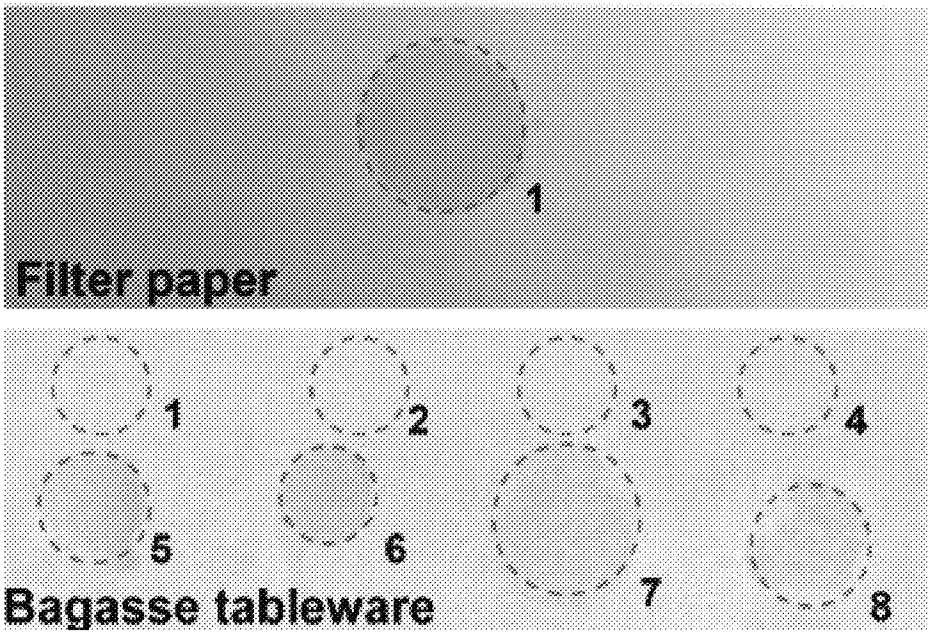

Likewise, hot temperature oil resistance was used to measure the capacity of the tableware against the penetration of oil with a temperature higher than 180° F.±5° F. (the detail of testing information is in the experimental section). For the resistances of oil at room and hot temperatures, commercial bagasse tableware (plate), commercial egg tray made from secondary fiber molded pulp (SFMP) and filter paper were used as control samples. As depicted in FIG. 11B and FIG. 3, the grease resistance of the molded pulp was at level 6, which was much higher than that of the SFMP (level 1), the commercial bagasse tableware (level 4), and the filter paper (level 1), highlighted its excellent resistance of oil at room temperature.

Figure 4:
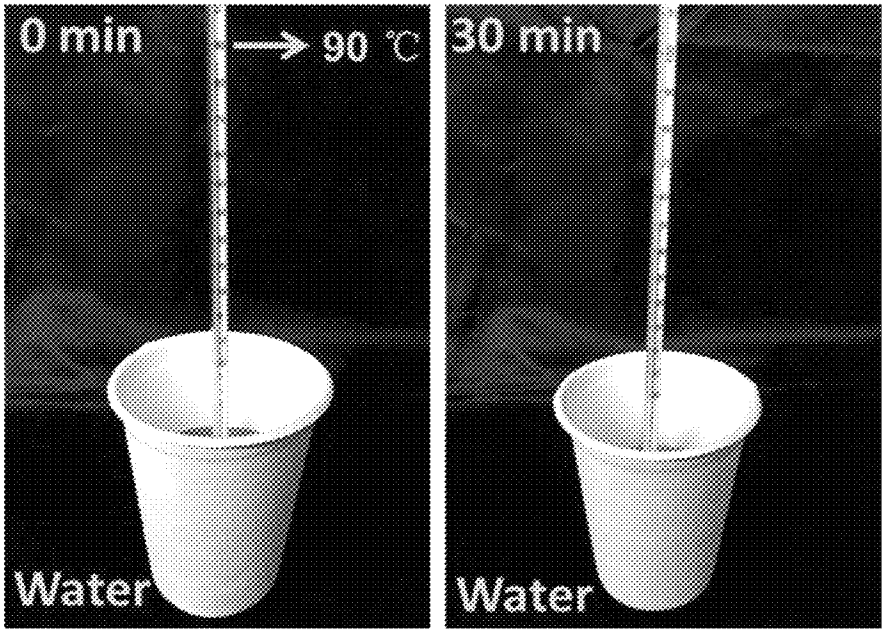
FIG. 4 shows photos of molded pulp cup showing good shape stability after containing hot water at 90° C. for 30 minutes, which indicates good hot water resistance.
Figure 11C:
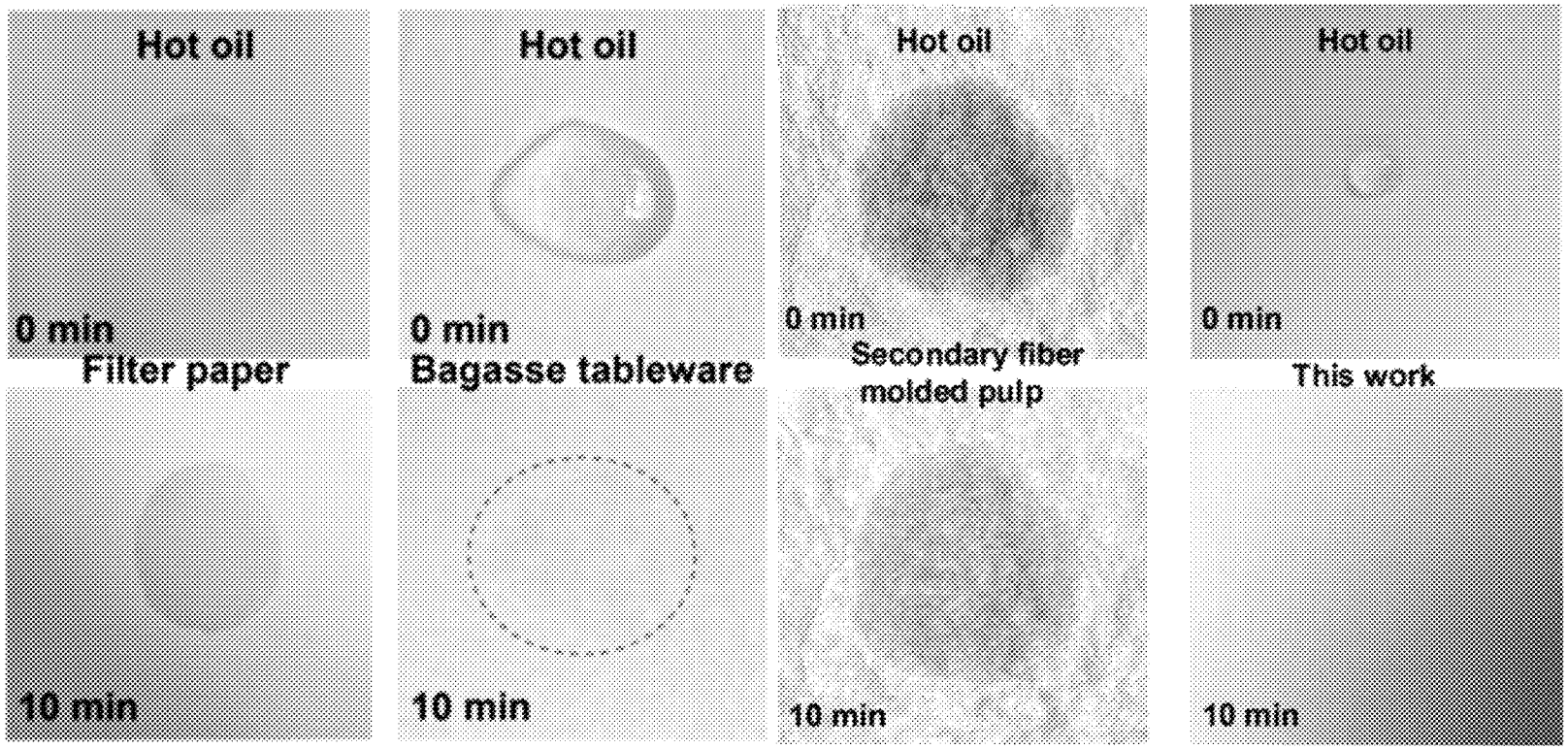
FIG. 11C are images of filter paper (far left images), bagasse tableware (second to left images), commercial egg tray (third to left images), and molded pulp tableware (right images), and show hot oil resistance.

Moreover, the resistance of the oil at high temperature was measured within a ten minutes scale after dropping hot soybean oil on the surface of the samples. As shown in FIG. 11C and FIG. 4, the hot oil was fast penetrated into the SFMP and filter paper once the hot oil was dropped on them (0 min), whereas the molded pulp tableware showed good resistance of the hot oil as no significant penetration was observed. In addition, the dropped oil was absorbed by using a cotton ball after 10 min penetration. Oil was found to penetrate into the SFMP, bagasse tableware and filter paper, but no significant penetration was found for the molded pulp. The oil temperature was further increased to 90° C. (194° F.) and the penetration time to 30 minutes. The molded pulp tableware still displayed no significant penetration after wrapping the oil. All these results demonstrated the excellent resistance of the molded pulp against the oil at both room and high temperature.

Figure 11D:
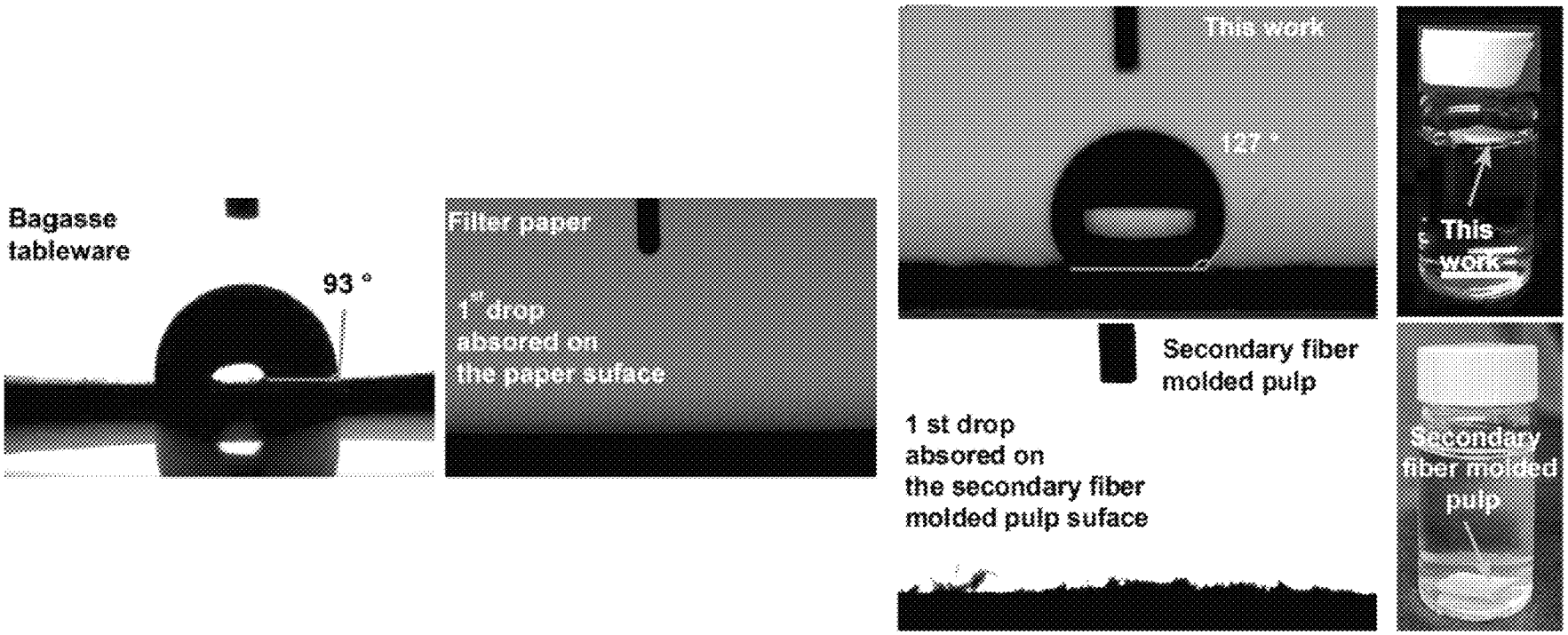
FIG. 11D shows contact angle of bagasse tableware (far left images), filter paper (second to the left images), molded pulp (top right images), and commercial egg tray (bottom right images).
Figure 11E:
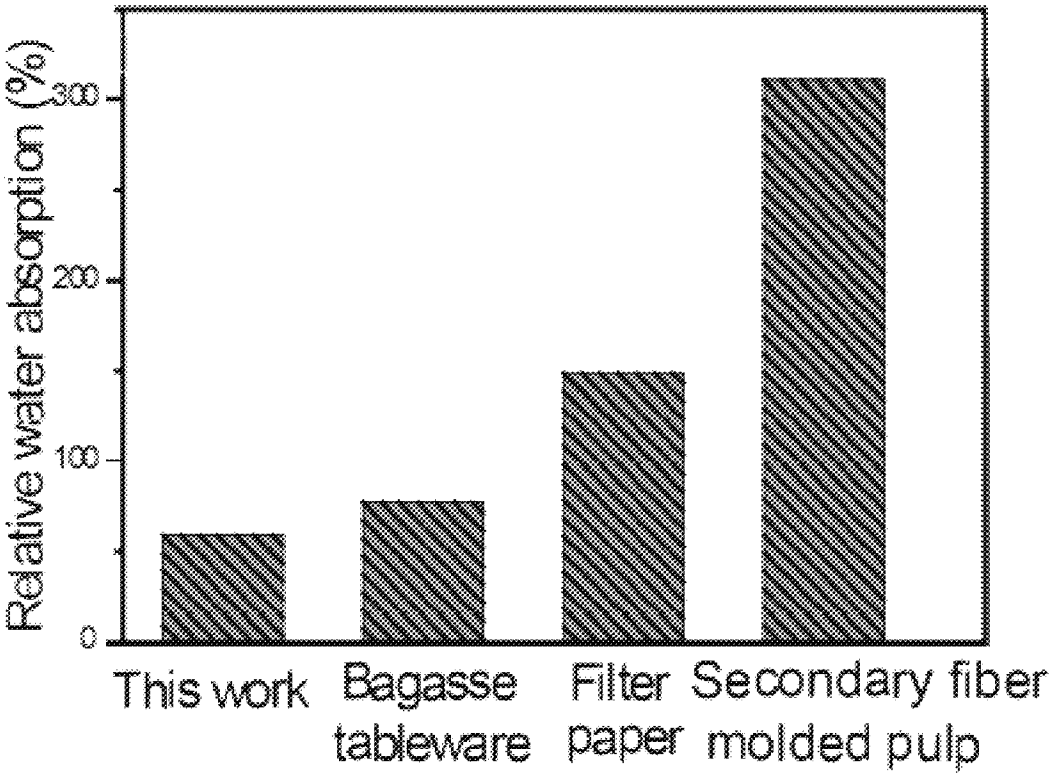
FIG. 11E shows water absorption of molded pulp (top images) and commercial egg tray (bottom images). Both oil and water resistances in FIGS. 11A-11E were measured using the secondary fiber molded pulp (SFMP), commercial bagasse tableware and filter paper as controls.

To evaluate the water resistance of the molded pulp, both contact angle and relative water absorption were determined. As shown in FIG. 11D and FIG. 4, the SFMP and filter paper did not display a contact angel and the commercial bagasse tableware showed a contact angle of 93°, while the molded pulp had a contact angle of 127°, revealed the much higher hydrophobicity of the molded pulp than the commercial bagasse tableware and SFMP. Additionally, when both SFMP and the molded pulp were placed on the deionized water, the former one sank to the bottom but the latter one floated on the surface (FIG. 11D). This difference was because that SFMP is highly hydrophilic and therefore sank to the bottom after absorbing water, while the molded pulp possesses high hydrophobicity that impeded water absorption and floated on the water surface. In fact, the molded pulp tableware, commercial bagasse tableware, SFMP and filter paper can absorb water at a certain content during the long-term immersion process for their 3D network structures as revealed by SEM characterization, but the molded pulp (59.4%) had much lower relative water absorption than the commercial bagasse tableware (77.5%), filter paper (149.2%) and SFMP (310%) (FIG. 11E), which could be induced by its high hydrophobicity and more dense structures (the detail of testing information is in the experimental section). All these results of the high hydrophobicity and low relative water absorption of the molded pulp revealed its high water-resistance. In fact, the cup made of molded pulp can hold hot water with a temperature of 90° C. (194° F.) for more than 30 min without any penetration, which further displayed its excellent resistance against even hot water. The molded pulp tableware, therefore, has displayed its great potential to be applied into food industry, such as hot drinking cup, lunch box and food tray, which could contribute significantly to the plastic replacement.

Figure 5:
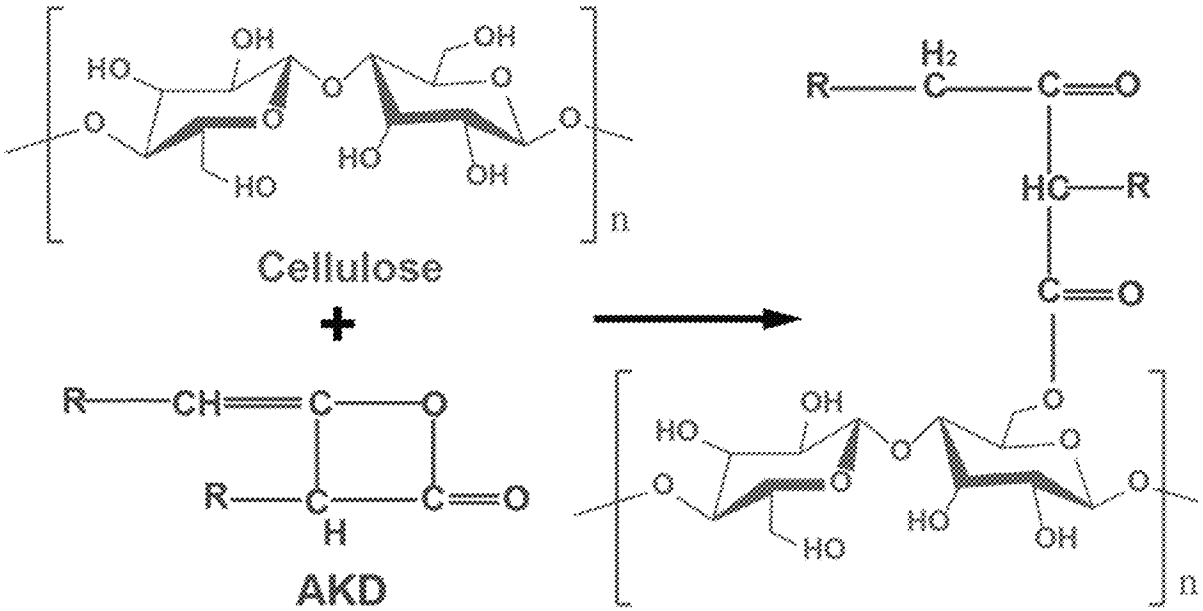
FIG. 5 shows the chemical modification during molded pulp tableware production for high water and oil resistance.

The mechanism of the excellent water and oil resistance should lie in the AKD that was added into the pulp. The reactive group (lactone group) of AKD can react with the primary hydroxyl group of cellulose through esterification to form β-carbonyl ester linkages (FIG. 5). Meanwhile, the hydrophobic group (long-chain alkyl group) turns to face away from the cellulose surface to endow cellulose a liquid-repellent property. All these changes contributed to the significant improvement of the water and oil resistances of the pulp products. Moreover, AKD can be safely used as an ingredient in food packaging, which highlighted the environmentally friendly and food-safe properties of the molded pulp tableware.

Figure 6A:
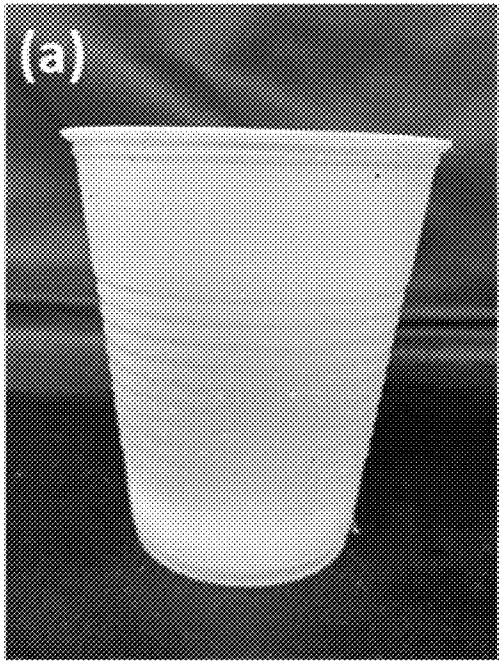
FIG. 6A shows a pristine polystyrene (PS) plastic cup.
Figure 6B:
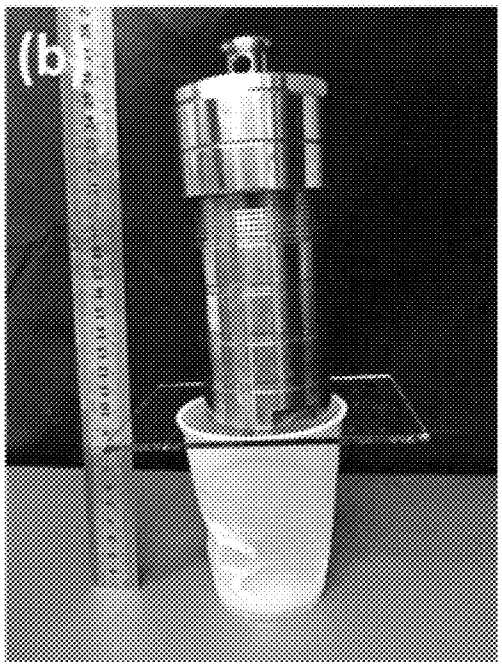
FIG. 6B shows a load-bearing test of the plastic cup from FIG. 6A, showing poor shape stability when holding 3 kg weight, which indicates weak stiffness.

Third, the tensile strength, Young's modulus, stiffness, and wet strength were the four crucial mechanical properties of the tableware, because molding materials with these good mechanical properties can meet the requirements of high load bearing capacity and transportation safety in humid environments. As shown in FIG. 12A and FIG. 12B, the molded pulp cup had much higher tensile strength and Young's modulus than the commercial PS plastic cup. The tensile strength of the molded pulp cup was 35.0 MPa, which was about 2-fold higher than that of the PS plastic cup (15.6 MPa) (FIG. 12A). Meanwhile, the Young's modulus of the molded pulp cup was 3.25 GPa, which was much higher than that of the PS plastic cup (1.40 GPa) (FIG. 12B). Moreover, there was a positive correlation between Young's modulus and stiffness. A 7.9 g molded pulp can withstand 3 kg weight (380 times of its own weight) in the vertical direction without obvious height change and deformation (FIG. 12C), whilst the PS plastic cup collapsed under this load (FIGS. 6A and 6B). As shown in FIG. 12D, the loadability of the molded pulp and PS cup was 1.07% and 4.37%, respectively. Both data demonstrated the excellent stiffness of the molded pulp tableware with promising prospects for large-scale applications. In addition, the tensile strength of the molded pulp was much higher than SFMP (1.1 MPa) and commercial bagasse tableware (16.9 MPa). These good mechanical properties of the molded pulp were attributed to the physical interwinding between mixed fibers, the residual lignin in the pulp, and fiber surface modification (FIG. 12E).

First, the physical interwinding between bagasse short fibers and bamboo long fibers increased the mechanical strength of molded pulp products. In addition, during the hot-pressing in molded pulp manufacturing, the remained lignin as a natural binder can enhance the binding between different components and the hydrogen bonds between microfibers. Meanwhile, phase transition of the remaining hydrophobic lignin might contribute to the water resistance and stiffness of molded pulp products. At last, the AKD hydrophobic treatment of the fiber surface made the samples less susceptible to the influence of the humid environment and thus enhanced the tensile strength of the molded pulp products.

Besides the mechanical performances discussed above, wet strength is another important mechanical performance of molded pulp cup, which is the strength of paper or paperboard in the wet state. To measure the wet strength, molded pulp cup was immersed into water for 8 h. To visualize the change of the molded pulp cup, indigo carmine (blue) was added into the water. As shown in FIG. 12F, the molded pulp cup maintained its good shape without collapse. After sucking the liquid on the surface of the paper cup by using filter paper, the wetted part on both sides of the paper cup was cut to measure its wet strength. As shown in FIG. 12G, compared with wet commercial bagasse tableware (3.57 MPa) and wet SFMP (0.07 MPa), the wet molded pulp cup had a tensile strength of 7.50 MPa, demonstrated its excellent wet mechanical property. Since the molded pulp cup was highly water resistant as revealed above, it was not a surprise that the fibers can prevent water swelling and thus kept the fiber network intact through the remaining hydrogen bonding along the internal microfibers, which thus gave the molded pulp tableware good wet strength.

Figure 7:
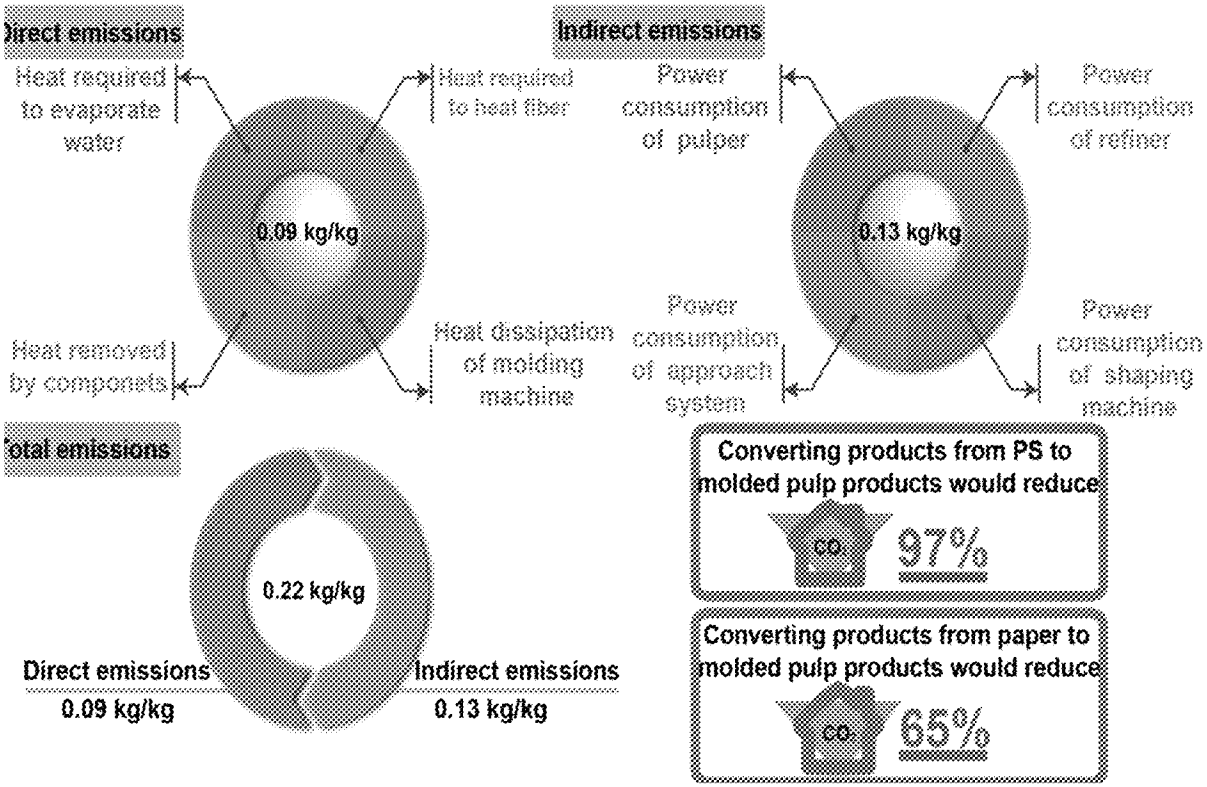
FIG. 7 shows a schematic diagram of carbon dioxide emissions assessment for the production of molded pulp products, and a comparison chart of carbon dioxide emissions from the production of expanded polystyrene and conventional paper. The $CO^2$ emission during molded pulp production was calculated by coal and electrical consumption multiplied by corresponding emission factors, respectively.

At last, the possible environmental impacts of the molded pulp manufacturing were evaluated. It is a matter of fact that the plastic originated from fossil fuel has a big carbon footprint for the chemical conversion of oil or gas into plastic resin. This traditional plastic production is also energy-intensive with high $CO_2$ emission. Carbon dioxide equivalent to the production of 1 kg of expanded PS plastic was 7.36 kg, and 1 kg of PLA was 0.50 kg. In contrast, the manufacture of molded pulp products was more energy-saving with lower $CO_2$ emission. According to the analysis and calculation of the carbon footprint of carton board products developed by Association of European Carton board and Carton Manufacturers (Pro-Carton), one ton of cardboard stores 1,474 kg of $CO_2$, and fossil emissions to produce one ton of converted carton board are 964 kg of $CO_2$. Therefore, the $CO_2$ equivalent of carton board products was 510 kg/ton (0.51 kg/kg). In addition, the power consumption per ton of the molded pulp production line was about 50% of the carton board production line, without the consideration of steam consumption. The estimated $CO_2$ equivalent of the product was 35% to 45% of the carton board, which was about 0.22 kg/kg. This total $CO_2$ emission data was 97% lower than that for PS production and even 65% lower for manufacturing analogical paper products and PLA plastic products (FIG. 7).

Figure 8:
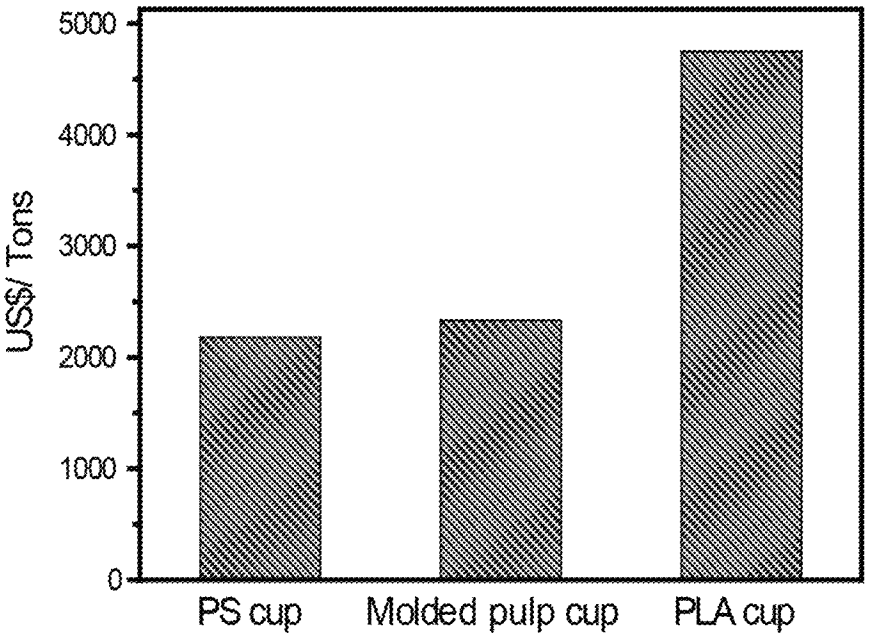
FIG. 8 shows the estimated cost (USD/ton) of producing PS cups, molded pulp cups and PLA cups.

Material cost is another key factor affecting the development of materials. Although PLA is a biodegradable bioplastic that can be manufactured by the polymerization of lactic acid monomers derived from starch feedstocks. PLA has its shortcomings, including high cost of production as compared to these petroleum-derived counterparts, inherently brittleness, low thermal resistance, and the conflict with societal demand of starch feedstocks (such as corn). In this work, the cost of molded pulp products mainly included production costs and period expenses. The cost of PLA was calculated based on Plastics Insight-Market Intelligence Portal for Plastics Industry and the cost of PS was from the reported data. As shown in FIG. 8, the cost of the molded pulp cups ($2333/ton) was two times lower than that of the PLA cups ($4750/ton) and close to that of the PS cups ($2177/ton).

Figures 13D, 13E, 13F:
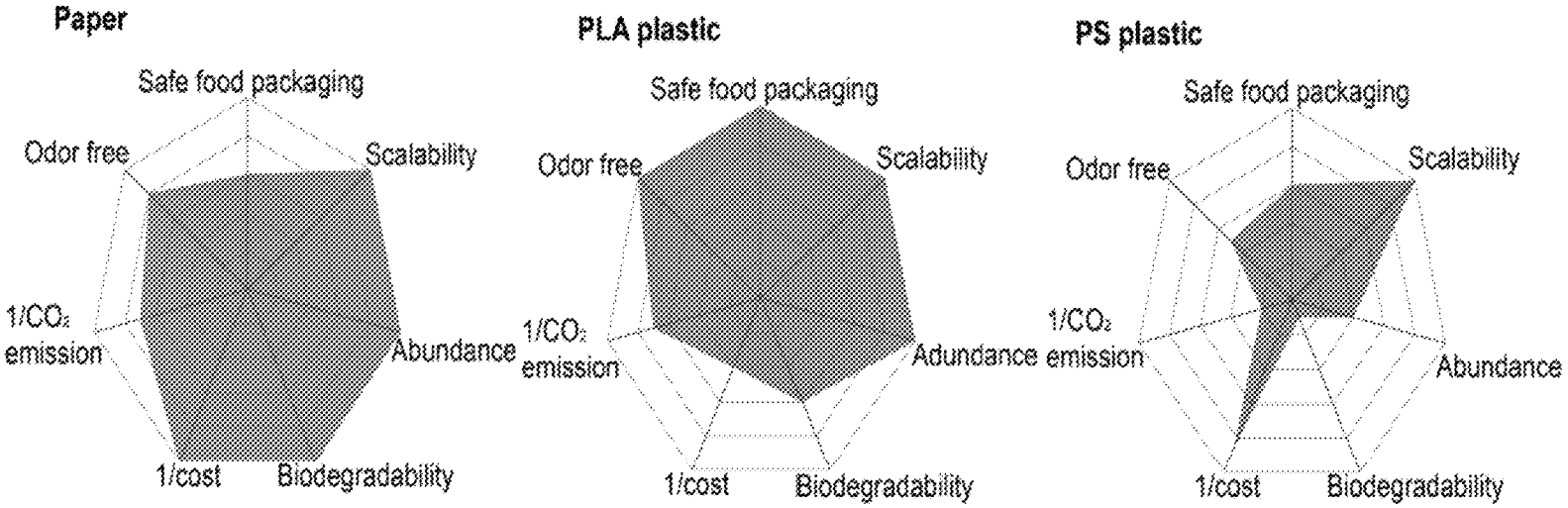
FIG. 13D is a radar plot of paper.
FIG. 13E is a radar plot of PLA plastic.
FIG. 13F is a radar plot of PS plastic.
Figure 14B:
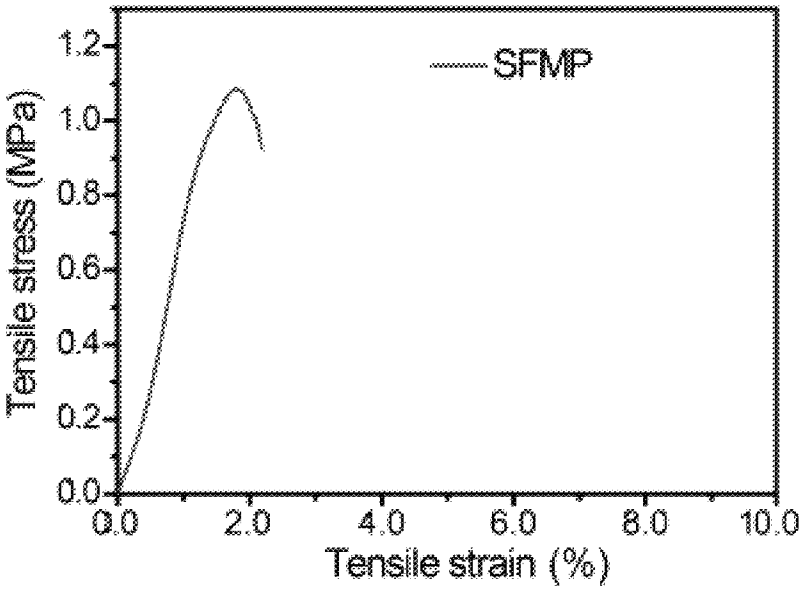
FIG. 14B shows the tensile strength of a secondary fiber molded pulp.
Figure 14A:
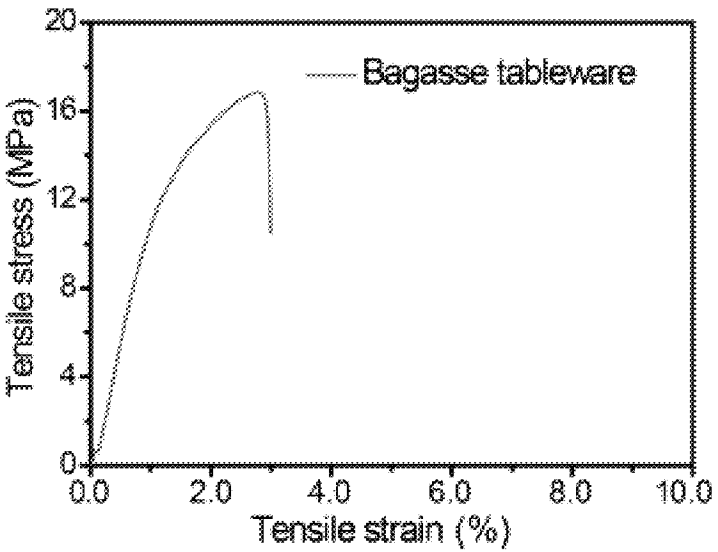
FIG. 14A shows the tensile strength of commercial bagasse tableware.

Additionally, to identify the compositional materials of different types of food packaging products, the component analysis was investigated. As shown in FIG. 13A, as compared with PS plastic products, the pulp fiber products (plastic replacement, secondary fiber molded pulp, and paper products) and PLA plastic materials are composed of natural and abundant polymers. Furthermore, to illustrate the overall performance of plastic replacement, radar plot to compare features between plastic replacements with other traditional food package products (secondary fiber molded pulp products, paper, PLA plastic, and PS plastic) was used. As can be seen, the molded pulp as plastic alternatives have superiorities in safe food packaging, abundance, odor-free, biodegradability, and low $CO_2$ emission. All these data highlighted that the molded pulp manufacturing has numerous advantages of being highly scalable for its low cost, low carbon emissions, and being environmentally friendly. Along with the inherent renewability, excellent biodegradability, and superior performances of both water and oil resistances and mechanical strength, the molded pulp products represented a potential replacement of the plastic and even PLA, which can pave the new avenue to solve current severe white pollution caused by the immoderate plastic utilizations.

Conclusions. Synthetic plastics, especially these for food packaging, have been ubiquitously used worldwide since the past decades. Most of these plastics are nonbiodegradable, which have induced severe environmental concerns. Replacing the plastics with biodegradable, compostable, and environmentally friendly materials represents an urgent need. In this work, all-naturally biodegradable, hygienic, water and oil stable, mechanically durable, low $CO_2$ emission, and low-cost tableware using eco-friendly sugarcane bagasse fiber and bamboo fiber through a scalable pulp molding method was developed. The content of toxic substances in molded pulp tableware used in food packaging was lower than international standards, in which Pb content was 0.3633 mg/kg and no As was detected, demonstrated the safety of the molded pulp products to be used in food packaging industry. The food-safe AKD grafted pulp fibers and precision molding process increased the hydrophobicity and hydrogen bonding between fibers. The molded pulp tableware demonstrated improved water (contact angel of 127°) and oil resistance (level 6) and high mechanical strength of 35.0 MPa. Furthermore, $CO_2$ emission from the production of molded pulp tableware was lower than that of PS plastic products and traditional papermaking. Meanwhile, low production costs made molded pulp tableware an excellent alternative to plastic and even the expensive PLA products. Therefore, this scalable molded pulp tableware is a desirable substitute for traditional nonbiodegradable plastics to be used for food packaging.

Experimental Procedures

Materials. The sugarcane bagasse pulp and bamboo pulp were collected from a pulp and paper company. Alkyl ketene dimer (AKD), castor oil, toluene, n-heptane, and indigo carmine were purchased from Sigma-Aldrich Inc., USA, and used as received.

Preparation of molded pulp products. The molded pulp machine (JZC2-9894) used in this study was fully automatic. In order to improve the mechanical properties of pulp molding while maintaining a good uniformity of pulp molding, a certain proportion of bamboo pulp fiber was added to the bagasse pulp. The proportion of raw fibers was 70% bagasse pulp and 30% bamboo pulp. The fiber was dispersed in a large amount of water at a concentration of 3.0-3.5% with a beating degree of 20-23° SR and then diluted to 0.3-0.5%. After that, a certain amount of AKD (0.5-1.0%) as water-proofing agent and oil-proofing agent was added. For the first stage dehydration, the pulp was dehydrated about 25-30 s under a vacuum of 0.03-0.035 MPa. In the second stage dehydration, a wet pulp with 50-55% moisture content was pressed for 25-30 s at a pressure of 25-27 MPa. Finally, the pulp was transferred to a hot mold to be molded for about 90-120 s at 185-190° C. with a pressure of 25-27 MPa.

Toxic substance content test. An ICP-OES equipped with a slurry nebulizer and a charge coupled device detector was used to determine the Pb and As contents of the samples. Before the test, 10.0 g of sample were put in a muffle furnace and then heated to a temperature of 550° C. for 8 h. The obtained ashes were cooled to room temperature and wetted by a small amount of nitric acid. Then, the wet samples were dried on a hot plate followed by transferred back to the muffle furnace until the ashes turned to white. Finally, the cooled ashes were dissolved in 10 ml of nitric acid and then diluted to 25 ml. Control without samples were measured with the same procedure simultaneously.

Water and oil resistances test. Grease resistance test for paper and paperboard were carried out for 12 grades of test solutions that were formulated from a series of different volume ratios of castor oil, toluene, and n-heptane, as shown in Table 2. Level 1 has the lowest grease resistance and level 12 has the highest grease resistance. During the test, a drop of liquid was dropped vertically from a height of approximately 13 mm. After the droplets staying on the paper for 15 s, excess liquid was removed using a cotton cloth. If dark marks appear, the grease resistance level was counted to be lower than the level represented by the test liquid. Each test was repeated at least three times to ensure the reliability of the data. The test method of hot temperature oil resistance was carried out as below. The paper sample (10×10 cm) was placed on a layer of paper towel located on a flat table. Then, 1-2 mL of soybean oil with 180° F.±5° F. was dropped on the surface of the paper sample. After 10 minutes, excess oil was wiped off with a paper towel or cotton ball. The sample becoming transparent indicated that the grease has penetrated into it, which suggested the poor oil resistance. To measure the water absorption, the sample was first cut into ten pieces with the size of 100×100 mm. Each piece was then weighed. After that, each sample was immersed completely in the water for 1 h, and then removed the sample and hanged it for one minute to let excess water drop before weighing it. The relative water absorption was calculated according to the following formula:

$$A = \frac{(m_2 - m_1)}{m_1} \times 100\%,$$

where A is the relative water absorption (%), $m_1$ represents the mass of the sample before absorbing liquid, and $m_2$ represents the mass of the sample after absorbing liquid.

Mechanical properties test. The tensile tests were conducted by using a universal tensile testing machine (Instron Model 5567) with a displacement speed of 10 mm $min^{-1}$ at room temperature. The sample was cut into the size of 15 mm in length and 3 mm in width. The thickness of the sample was about 0.6 mm. For wet strength tests, the samples were soaked in water for 8 h and then extra water was removed by tissue paper before tests. The test method was the same as aforementioned tensile test. The formula for calculating the compression load bearing performance of a sample was as followed. Multiple samples were measured to get an average data.

$$W=[(H_0-H)/H_0]\times 100\%,$$

where W is the compression load ability of the sample, $H_0$ (mm) is the height of the sample without load, H (mm) represents the height of a sample under a load for one min. The larger the loadability value, the worse the compression load-bearing performance is.

Morphological and contact angle characterizations. The morphology and cross section of molded pulp cup were characterized by scanning electron microscopy (SEM, Hitachi 54800, Hitachi Ltd., Japan) with a working distance of 8 mm and a voltage of 5 kV. The molded pulp sample was sputter-coated with a layer of gold-palladium (10 nm) to make the sample conductive. Fiber morphology was also characterized with a perpendicular polarizing microscopy (PLM) (DM2700M, Leica Microsystems GmbH, Germany) and a fiber quality analyzer (FS300, Finland). The contact angle was tested by a Contact Angle Analyzer (SEO Phoenix 150, Korea) at room temperature.

REFERENCES

1. Chandra, M., Kohn, C., Pawlitz, J., and Powell, G. (2016). Real cost of styrofoam. In Experiential Learning Project, Saint Louis University. https://greendiningalliance.org/wp-content/uploads/2016/12/real-cost-of-styrofoam_written-report.pdf 2. Gu, L., and Ozbakkaloglu, T. (2016). Use of recycled plastics in concrete: A critical review. Waste Manage. 51, 19-42.
3. Gooljar, J. (2018). Fact sheet: How much disposable plastic we use. https://www.earthday.org/fact-sheet-how-much-disposable-plastic-we-use/.
4. LeBlanc, R. (2017). How long does it take garbage to decompose. https://recycling.about.com/od/Resources/fl/How-Long-Does-It-Take-Garbage-to-Decompose.
5. Barnes, D. K., Galgani, F., Thompson, R. C., and Barlaz, M. (2009). Accumulation and fragmentation of plastic debris in global environments. Philos. Trans. R. Soc. Lond. B Biol. Sci. 364, 1985-1998.
6. Panyakapo, P., and Panyakapo, M. (2008). Reuse of thermosetting plastic waste for lightweight concrete. Waste Manage. 28, 1581-1588.
7. Chidambarampadmavathy, K., Karthikeyan, O. P., and Heimann, K. (2017). Sustainable bio-plastic production through landfill methane recycling. Renew. Sustain. Energ. Rev. 71, 555-562.
8. Verma, R., Vinoda, K. S., Papireddy, M., and Gowda, A. N. S. (2016). Toxic pollutants from plastic waste—A review. Procedia Environ. Sci. 35, 701-708.
9. Degnan, T., and Shinde, S. L. (2019). Waste-plastic processing provides global challenges and opportunities. MRS Bull. 44, 436-437.
10. Pennington, J. (2016). In Every minute, one garbage truck of plastic is dumped into our oceans, this has to stop. https://www.weforum.org/agenda/2016/10/every-minute-one-garbage-truck-of-plastic-is-dumped-into-our-oceans.
11. Nilsson, H., Galland, S., Larsson, P. T., Gamstedt, E. K., and Iversen, T. (2012). Compression molded wood pulp biocomposites: A study of hemicellulose influence on cellulose supramolecular structure and material properties. Cellulose 19, 751-760.
12. Chen, Y., Wan, J., Zhang, X., Ma, Y., and Wang, Y. (2012). Effect of beating on recycled properties of unbleached eucalyptus cellulose fiber. Carbohyd. Polym. 87, 730-736.
13. Didone, M., Saxena, P., Brilhuis-Meijer, E., Tosello, G., Bissacco, G., McAloone, T. C., Pigosso, D. C. A., and Howard, T. J. (2017). Moulded pulp manufacturing: Overview and prospects for the process technology. Packag. Technol. Sci. 30, 231-249.
14. Masni-Azian, A., Choudhury, I. A., Sihombing, H., and Yuhazri, M. Y. (2013). Tensile properties evaluation of paper pulp packaging at different sections and orientations on the egg tray. Adv. Mater. Res. 626, 542-546.
15. Usda, F. (2017). Sugar: World markets and trade. https://www.fas.usda.gov/data/sugar-world-markets-and-trade.
16. Kiatkittipong, W., Wongsuchoto, P., and Pavasant, P. (2009). Life cycle assessment of bagasse waste management options. Waste Manage. 29, 1628-1633.
17. Ramos, J., Rojas, T., Navarro, F., Dávalos, F., Sanjuán, R., Rutiaga, J., and Young, R. A. (2004). Enzymatic and fungal treatments on sugarcane bagasse for the production of mechanical pulps. J. Agr. Food. Chem. 52, 5057-5062.
18. Phuong, H. A. L., Ayob, N. A. I., Blanford, C. F., Rawi, N. F. M., and Szekely, G. (2019). Non-woven membrane supports from renewable resources: bamboo fiber reinforced poly(lactic acid) composites. ACS Sustain. Chem. Eng. 7, 11885-11893.
19. Han, S., Yao, Q., Jin, C., Fan, B., and Zheng, H. (2018). Cellulose nanofibers from bamboo and their nanocomposites with polyvinyl alcohol: Preparation and characterization. Polym. Composite. 39, 2611-2619.
20. Lianos, J. H. R., and Tadini, C. C. (2018). Preparation and characterization of bio-nanocomposite films based on cassava starch or chitosan, reinforced with montmorillonite or bamboo nanofibers. Int. J. Biol. Macromol. 107, 371-382.
21. de Sá, D. S., de Andrade Bustamante, R., Rocha, C. E. R., da Silva, V. D., da Rocha Rodrigues, E. J., Müller, C. D. B., Ghavami, K., Massi, A., and Pandoli, O. G. (2019) Fabrication of lignocellulose-based microreactors: Copper-functionalized bamboo for continuous-flow cuaac click reactions. ACS Sustain. Chem. Eng. 7, 3267-3273.
22. Wang, X., Pang, Z., Chen, C., Xia, Q., Zhou, Y., Jing, S., Wang, R., Ray, U., Gan, W., and Li, C. (2020). All-natural, degradable, rolled-up straws based on cellulose micro- and nano-hybrid fibers. Adv. Funct. Mater. 30, 1910417-1910428.
23. Karamfilova, E., and Sacher, M. (2016). Food contact materials—regulation (ec) 1935/2004 european implementation assessment.
https://www.europarl.europa.eu/RegData/etudes/STUD/2016/581411/EPRS_STU(2016)5814 11_EN.pdf.
24. Standard, C. (2016). National food safety standard-food contact paper and board materials and their products, In GB 4806.8-2016.
25. Tyagi, P., Lucia, L. A., Hubbe, M. A., and Pal, L. (2019). Nanocellulose-based multilayer barrier coatings for gas, oil, and grease resistance. Carbohyd. Polym. 206, 281-288.
26. Lindström, T., and Larsson, P. T. (2008). Alkyl ketene dimer (AKD) sizing—A review. Nord. Pulp. Pap. Res. J. 23, 202-209.
27. Ross, S., and Evans, D. (2003). The environmental effect of reusing and recycling a plastic-based packaging system. J. Clean. Prod. 11, 561-571.
28. Morão, A., and Bie, F. (2019). Life cycle impact assessment of polylactic acid (pla) produced from sugarcane in Thailand. J. Polym. Environ. 27, 2523-2539.
29. Eriksson, E., Karlsson, P.-E., Hallberg, L., and Jelse, K. (2010). Carbon footprint of cartons in Europe—Carbon footprint methodology and biogenic carbon sequestration. https://www.osti.gov/etdeweb/biblio/985454.
30. Tokiwa, Y., Calabia, B. P., Ugwu, C. U., and Aiba, S. (2009). Biodegradability of plastics. Int. J. Mol. Sci. 10, 3722-3742.
31. Koh, J. J., Zhang, X., and He, C. (2018). Fully biodegradable poly (lactic acid)/starch blends: A review of toughening strategies. Int. J. Biol. Macromol. 109, 99-113.
32. Wang, Q., Xiao, S., Shi, S. Q., and Cai, L. (2018). Effect of light-delignification on mechanical, hydrophobic, and thermal properties of high-strength molded fiber materials. Sci. Rep. 8, 1-10.
33. Fillat, U., de Eugenio, L. I., and Martinez, M. J. (2015). Assessing enzymatic deinking for secondary fibers paper recycling in the presence of flexographic inks. Chem. Eng. J. 260, 486-491.
34. Franz, R. (2002). Programme on the recyclability of food-packaging materials with respect to food safety considerations: Polyethylene terephthalate (PET), paper and board, and plastics covered by functional barriers. Food Addit. Contam. A. 19, 93-110.
35. Garlotta, D. (2001). A literature review of poly (lactic acid). J. Polym. Environ. 9, 63-84.
36. Geueke, B., Groh, K., Muncke, J. (2018). Food packaging in the circular economy: Overview of chemical safety aspects for commonly used materials. J. Clean. Prod. 193, 491-505.

The foregoing Example has been described in Chao Liu, Pengcheng Luan, Qiang Li, Zheng Cheng, Xiao Sun, Daxian Cao, Hongli Zhu, Biodegradable, Hygienic, and Compostable Tableware from Hybrid Sugarcane and Bamboo Fibers as Plastic Alternative. *Matter,* 2020; DOI: 10.1016/j.matt.2020.10.004. The contents of this reference and all supplemental information and materials are incorporated herein by reference in their entirety.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed:

1. A mixed pulp composition comprising a short fiber plant pulp and a long fiber plant pulp, wherein the composition does not include wood fiber and fibers from the long fiber plant pulp and fibers from the short fiber plant pulp are intertwined, and wherein the composition comprises a) between about 60% short fiber plant pulp by weight and about 80% short fiber plant pulp by weight; or b) between about 20% long fiber plant pulp by weight and about 40% long fiber plant pulp by weight.

2. The composition of claim 1, wherein the short fiber plant pulp comprises corn fiber, grass fiber, straw fiber, or sugar cane fiber, or a combination of any of the foregoing.

3. The composition of claim 1, wherein the short fiber plant pulp comprises sugar cane fiber.

4. The composition of claim 1, wherein the short fiber plant pulp comprises, consists essentially of, or consists of sugar cane bagasse.

5. The composition of claim 1, wherein the long fiber plant pulp comprises hemp fiber, flax seed fiber, or bamboo fiber, or a combination of any of the foregoing.

6. The composition of claim 1, wherein the long fiber plant pulp comprises, consists essentially of, or consists of bamboo fiber.

7. The composition of claim 1, in the form of a homogeneous mixture.

8. The composition of claim 1, in solid form.

9. The composition of claim 1, wherein the composition further comprises a paper sizing agent.

10. The composition of claim 9, wherein the composition comprises from about 0.1% to about 10% by weight paper sizing agent.

11. The composition of claim 9, wherein the paper sizing agent is rosin, alkyl ketene dimer, or alkenyl succinic dimer.

12. The composition of claim 11, wherein the paper sizing agent is an alkyl ketene dimer.

13. The composition of claim 1, comprising from about 60% to about 80% sugar cane bagasse by weight and from about 20% to about 40% bamboo fiber by weight.

14. The mixed pulp composition of claim 13, further comprising from about 0.1% to about 5% alkyl ketene dimer by weight.

15. The composition of claim 1, in the form of tableware, a toy, a packing product, or a sanitary consumable.

16. The composition of claim 1, wherein the composition has grease resistance of level 5 or higher, as measured by grease resistance standard of Technical Association of the Pulp and Paper Industry T559.

17. The composition of claim 1, wherein the composition has water absorption of less than about 75%, as measured by immersion of a 100 mm×100 mm sample in water for about one hour.

* * * * *